US005219716A

United States Patent [19]

Takada et al.

[11] Patent Number: 5,219,716

[45] Date of Patent: Jun. 15, 1993

[54] METHOD FOR PROCESSING A LIGHT-SENSITIVE SILVER HALIDE PHOTOGRAPHIC MATERIAL CONTAINING A YELLOW COUPLER BY USING A LOW REPLENISHING COLOR DEVELOPER

[75] Inventors: Shun Takada; Takahiro Ogawa, both of Odawara, Japan

[73] Assignee: Konica Corporation, Tokyo, Japan

[21] Appl. No.: 603,812

[22] Filed: Oct. 26, 1990

[30] Foreign Application Priority Data

Oct. 30, 1989 [JP] Japan ..... 1-284383

[51] Int. Cl.[5] ..... G03C 7/36; G03C 5/31

[52] U.S. Cl. ..... 430/389; 430/399; 430/557

[58] Field of Search ..... 430/556, 389, 399, 442, 430/557

[56] References Cited

U.S. PATENT DOCUMENTS 4,857,444 8/1989 Hirose et al. ..... 430/556
4,968,594 11/1990 Shimazaki et al. ..... 430/556
5,023,169 6/1991 Hirabayashi et al. ..... 430/556

*Primary Examiner*—Charles L. Bowers, Jr.
*Assistant Examiner*—Mark F. Huff
*Attorney, Agent, or Firm*—Finnegan, Henderson, Farabow, Garrett & Dunner

[57] ABSTRACT

Disclosed are a light-sensitive silver halide photographic material characterized in that the light-sensitive silver halide photographic material is processed with a color developer in an amount of 20 to 150 ml/m$^2$ replenished and contains a yellow coupler represented by the formula (Y-1) shown below:

Formula (Y-1)

wherein $R_1$ represents alkyl, cycloalkyl or aryl group; $R_2$ an alkyl, cycloalkyl, aryl or acyl group; $R_3$ is a group substitutable on benzene ring; n is 0 or 1; $X_1$ represents a group eliminable during coupling with the oxidized product of a developing agent; and $Y_1$ an organic group and a method for processing the same.

31 Claims, No Drawings

METHOD FOR PROCESSING A LIGHT-SENSITIVE SILVER HALIDE PHOTOGRAPHIC MATERIAL CONTAINING A YELLOW COUPLER BY USING A LOW REPLENISHING COLOR DEVELOPER

BACKGROUND OF THE INVENTION

This invention relates to a light-sensitive silver halide photographic material and a method for processing the same, particularly to a light-sensitive silver halide photographic material excellent in stability of photographic performances even when subjected to low replenishing continuous processing.

Generally speaking, light-sensitive silver halide photographic materials are processed in respective steps of color developing, bleach-fixing (or bleaching and fixing), stabilizing. However, color developers have the problem that they are susceptible to oxidation with air or metals, and when color images are formed by use of oxidized developers, the photographic characteristics will change, whereby there has been the drawback that no inherent photographic characteristic can be obtained.

In recent years, for the purpose of causing no pollution, low replenishing processing has been desired. In such low replenishing, the problems for photographic characteristics as mentioned above are particularly great.

Japanese Unexamined Patent Publication No 211750/1989 discloses a processing technique with a lowered replenished amount of color developer.

However, in the processing technique in Japanese Unexamined Patent Publication No. 211750/1989, when low replenishing continuous processing is performed, there has been involved the drawback that stability of photographic performances is inferior and color reproducibility is insufficient.

Accordingly, an object of the present invention is to provide a light-sensitive silver halide photographic material which is excellent in stability of photographic performances and sufficient in color reproducibility even when subjected to low replenishing continuous running processing.

SUMMARY OF THE INVENTION

After extensive investigation, the present invention was found to accomplish those objectives while overcoming the prior art problems.

More specifically, the light-sensitive silver halide photographic material according to the present invention is characterized in that the light-sensitive silver halide photographic material is processed with a color developer in an amount of 20 to 150 ml/m$^2$ replenished and contains a yellow coupler represented by the formula (Y-I) shown below:

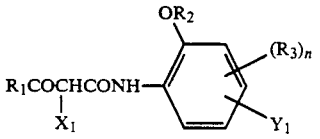

Formula (Y-1)

wherein $R_1$ represents an alkyl, cycloalkyl or aryl group; $R_2$ an alkyl, cycloalkyl, aryl or acyl group; $R_3$ a group substitutable on benzene ring; n is 0 or 1; $X_1$ represents a group eliminable during coupling with the oxidized product of a developing agent; and $Y_1$ an organic group.

DESCRIPTION OF THE PREFERRED EMBODIMENT

First, the yellow coupler represented by the above formula (Y-I) is described.

In the above formula (Y-I), the alkyl group represented by $R_1$ may include, for example, methyl, ethyl, isopropyl, t-butyl, dodecyl groups and the like. These alkyl groups represented by $R_1$ also include those having substituents, and examples of substituents may include halogen atoms, aryl groups, alkoxy groups, aryloxy groups, alkylsulfonyl groups, acylamino groups, hydroxy group.

As the cycloalkyl group represented by $R_1$, there may be included cyclopropyl group, cyclohexyl group and adamantyl group.

As the aryl group represented by $R_1$, phenyl group, etc. may be included. Preferable as $R_1$ is a branched alkyl group.

In the formula (Y-I), as the alkyl groups and cycloalkyl groups represented by $R_2$, the same groups as $R_1$ may be included, and the aryl group may be, for example, phenyl group. The alkyl groups, cycloalkyl groups and aryl groups represented by $R_2$ also include those having the same substituents as $R_1$. As the acyl group, there may be included acetyl group, propionyl group, butyryl group, hexanoyl group, benzoyl group, etc.

Preferable as $R_2$ are alkyl groups, aryl groups, more preferably alkyl groups, further preferably lower alkyl groups having carbon atoms of 5 or less.

In the formula (Y-I), as the groups substitutable on the benzene ring represented by $R_3$, there may be included halogen atoms (e.g. chlorine atom), alkyl groups (e.g. ethyl, i-propyl, t-butyl groups), alkoxy groups (e.g. methoxy group), aryloxy groups (e.g. phenyloxy group), acyloxy groups (e.g. methylcarbonyloxy, benzoyloxy groups), acylamino groups (e.g. acetamido, phenylcarbonylamino groups), carbamoyl groups (e.g. N-methylcarbamoyl, N-phenylcarbamoyl groups), alkylsulfonamide groups (e.g. ethylsulfonamide group), arylsulfonamide groups (e.g. phenylsulfonamide group), sulfamoyl groups (e.g. N-propylsulfamoyl group, N-phenylsulfamoyl group) and imide groups (e.g. succinimide, glutarimide groups), etc. n represents 0 or 1.

In the formula (Y-I), $Y_1$ represents an organic group, preferably a group represented by the following formula (Y-II), which is not limitative of the invention.

$$-J-R_4 \qquad \text{Formula (Y-II)}$$

In the formula (Y-II), $R_4$ represents an organic group containing one bonding group having carbonyl or sulfonyl unit.

As the group having carbonyl unit, there may be included ester group, amide group, carbamoyl group, ureido group, urethane group, etc., and as the group having sulfonyl unit, sulfonyl group, sulfonamide group, sulfamoyl group, aminosulfonamide group, etc.

J represents $$-\underset{\underset{R_5}{|}}{N}CO- \text{ or } -\underset{\underset{R_5}{|}}{N}CO-,$$

and $R_5$ represents hydrogen atoms, an alkyl group, aryl group or heterocyclic group.

As the alkyl group represented by $R_5$, methyl, ethyl, isopropyl t-butyl, dodecyl groups, etc. may be included. As the aryl group represented by $R_5$, phenyl group or naphthyl group, etc. may be included.

These alkyl groups or aryl groups represented by $R_5$ also include those having substituents. Substituents are not particularly limited, but representative examples may include halogen atoms (chlorine atom, etc.), alkyl groups (ethyl, t-butyl groups, etc.), aryl groups (phenyl, p-methoxyphenyl, naphthyl groups, etc.), alkoxy groups (ethoxy, benzyloxy groups, etc.), aryloxy groups (phenoxy group, etc.), alkylthio groups (ethylthio group, etc.), arylthio groups (phenylthio group, etc.), alkylsulfonyl groups (β-hydroxyethylsulfonyl group, etc.), arylsulfonyl groups (phenylsulfonyl group etc.) and also include acylamino groups such as alkylcarbonylamino groups (acetamide group, etc.), arylcarbonylamino groups (phenylcarbonylamino group, etc.), etc., including also carbamoyl groups substituted with, for example, alkyl groups, aryl groups (preferably phenyl group), etc., specifically N-methyl-carbamoyl group, N-phenylcarbamoyl group, etc, further acyl groups, for example, alkylcarbonyl groups such as acetyl group, arylcarbonyl groups such as benzoyl group, etc. Further, there may be also included sulfonamide groups, for example, alkylsufonamide groups, arylsulfon-amide groups, specifically methylsufonylamino group, benzenesulfonamide group, etc., including also those substituted with sulfamoyl group, alkyl group, aryl group (preferably phenyl group), etc., specifically N-methyl-sulfamoyl group, N-phenylsulfamoyl group, etc., and further hydroxyl group, nitrile group, etc.

In the formula (Y-I), $X_1$ represents a groups which is eliminated during the coupling reaction with the oxidized product of a developing agent, for example a groups represented by the formula (Y-III) or (Y-Iv) shown below, preferably a group represented by the formula (Y-IV).

$$-OR_6 \qquad \text{Formula (Y-III)}$$

In the formula (Y-III), $R_6$ represents an aryl group or a heterocyclic group including also those having substituents.

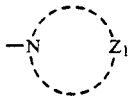

Formula (Y-IV)

In the formula (Y-IV), $Z_1$ represents a group of non-metallic atoms necessary for formation of a 5- to 6-membered ring together with nitrogen atom. Here, as the atomic group necessary for formation of the non-metallic atom group, for example, methylene, methine, substituted methine, >C=O, $$-\overset{|}{N}R_A$$

($R_A$ is the same as the above $R_5$), —N=, —O—, —S—, —$SO_2$—, etc.

The yellow coupler represented by the above formula (Y-I) may also form a bis-derivative by bonding at $R_1$, $R_3$ or $Y_1$ moiety.

Preferable as the yellow coupler of the present invention are compounds represented by the formula (Y-V) shown below.

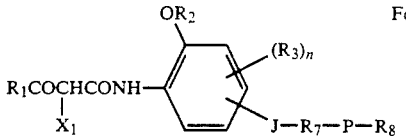

Formula (Y-V)

In the formula (Y-V), $R_1$, $R_2$, $R_3$ and J represent the same groups as $R_1$, $R_2$, $R_3$ in the formula (Y-I) and J in the formula (Y-II). n represents 0 or 1. $R_7$ represents an alkylene, arylene, alkylenearylene, arylenealkylene group or —A—$V_1$—B— (A and B each represent an alkylene, arylene, alkylenearylene or arylenealkylene group, and $V_1$ represents a divalent linking group), and $R_8$ represents an alkyl, cycloalkyl, aryl or heterocyclic group. P represents a bonding group having carbonyl or sulfonyl unit. $X_1$ represents a group eliminable during coupling with the oxidized product of a developing agent.

In the formula (Y-V), as the alkylene group represented by $R_7$, for example, methylene, ethylene, propylene, butylene, hexylene groups may be included, and further those having substituents are also included, as exemplified by those substituted with alkyl groups such as methyl-methylene group, ethyl-ethylene group, 1-methyl-ethylene group, 1-methyl-2-ethyl-ethylene group, 2-decyl-ethylene group, 3-hexyl-propylene group, 1-benzyl ethylene group, and those substituted with aryl groups such as 2-phenyl-ethylene group, 3-napthyl-propylene group.

As arylene groups, for example, phenylene group, naphthylene group may be included.

As alkylenearylene groups, for example, methylenephenylene group, etc., and as arylenealkylene group, phenylenemethylene group, etc. may be included.

The alkylene group, arylene group or alkylenearylene group or arylenealkylene group represented by A and B represent the alkylene group, arylene group, alkylene-arylene group and arylenealkylene group represented by $R_7$ in the above formula (Y-V), and as the divalent linking group represented by $V_1$, groups such as —O—, —S—, etc. may be included.

Among the alkylene group, arylene group, alkylenearylene group, arylenealkylene group represented by $R_7$ and —A—$V_1$—B—, particularly alkylene group is preferred.

In the above formula (Y-V), the alkyl group represented by $R_8$ may include, for example, ethyl, butyl, hexyl, octyl, dodecyl, hexadecyl, octadecyl groups and the like, and these alkyl groups may be either straight or branched. As the cycloalkyl group, cyclohexyl group, etc. may be included. As the aryl group, phenyl group, naphthyl group, etc. may be included. As the heterocyclic group, pyridyl group, etc. may be included. These alkyl groups, cycloalkyl groups, aryl groups and heterocyclic groups represented by $R_8$ may also include those having further substituents.

The substituent is not particularly limited, but may include the same groups as the substituents on $R_5$ as described above. However, as the substituent on $R_8$, organic groups having dissociable hydrogen atom with a pKa value of 9.5 or less (e.g. phenolic hydrogen atom, etc.) are not preferable.

In the above formula (Y-V), P represents a bonding group having carbonyl or sulfonyl unit, preferably a group represented by the following group (Y-VI), further preferably a bonding group having sulfonyl unit:

Group (Y-VI)

1) $-COO-$, 2) $-\underset{\underset{R}{|}}{N}CO-$,

3) $-\underset{\underset{R}{|}}{C}ON-$, 4) $-\underset{\underset{R}{|}}{N}C\underset{\underset{R'}{|}}{O}N-$, 5) $-\underset{\underset{R}{|}}{N}COO-$, 6) $-SO_2-$, -continued 7) $-\underset{\underset{R}{|}}{N}SO_2-$, 8) $-SO_2\underset{\underset{R}{|}}{N}-$, 9) $-\underset{\underset{R}{|}}{N}SO_2\underset{\underset{R'}{|}}{N}-$, In the formulae, R and R′ represent hydrogen atom, alkyl group, aryl group, heterocyclic group, and R and R′ may be either the same or different.

As the group represented by R and R′, there may be included the same groups as the above $R_5$. Also, these groups include those having the same substituents as on $R_5$. R and R′ may be preferably hydrogen atoms.

The yellow coupler represented by the above formula (Y-I) of the present invention can be used in an amount ranging from $1\times10^{-3}$ mole to 1 mole, more preferably from $1\times10^{-2}$ mole to $8\times10^{-1}$ mole, per 1 mole of silver halide.

In the following, specific examples of the yellow coupler represented by the above formula (Y-I) are shown.

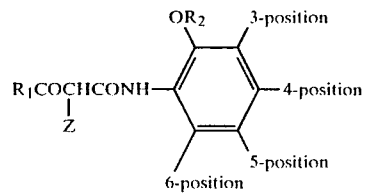
| No. | $R_1$ | $R_2$ | Z | Substituted position on aromatic ring: 3 | 4 | 5 | 6 |
|---|---|---|---|---|---|---|---|
| Y-1 | $(t)C_4H_9$— | —$CH_3$ | 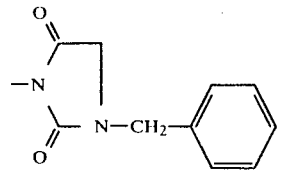 | —H | —H | 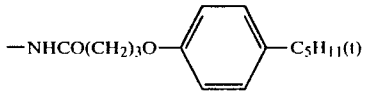 | —H |
| Y-2 | $(t)C_4H_9$— | —$CH_3$ | 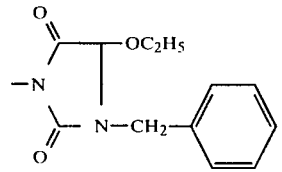 | —H | —H | 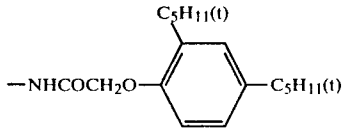 | —H |
| Y-3 | $(t)C_4H_9$— | —$CH_3$ | 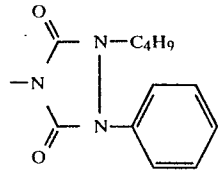 | —H | —H | 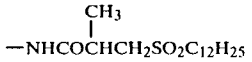 | —H |
| Y-4 | $(t)C_4H_9$— | —$CH_3$ | 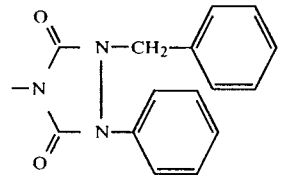 | —H | —H | 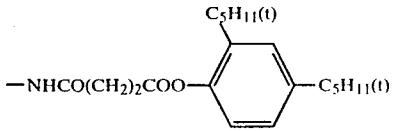 | —H |

-continued
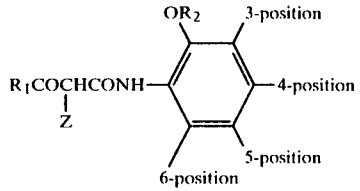
| No. | $R_1$ | $R_2$ | Z | Substituted position on aromatic ring 3 | 4 | 5 | 6 |
|---|---|---|---|---|---|---|---|
| Y-5 | (t)$C_4H_9$— | —$CH_3$ | 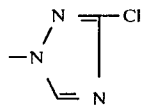 | —H | —H | 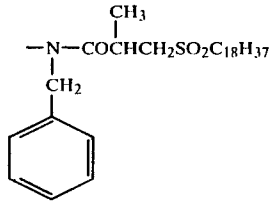 | —H |
| Y-6 | (t)$C_4H_9$— | —$CH_3$ | 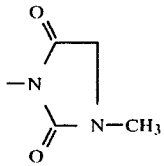 | —H | —H | —$NHCOCHCH_2SO_2C_{12}H_{25}$ (CH3) | —H |
| Y-7 | (t)$C_4H_9$— | —$CH_3$ | 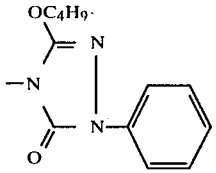 | —H | —H | —$NHCO(CH_2)_2CONHC_{12}H_{25}$ ($C_2H_5$) | —H |
| Y-8 | (t)$C_4H_9$— | —$C_3H_7$(iso) | 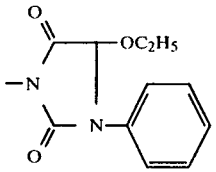 | —H | —H | 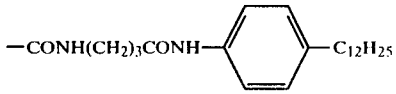 | —H |

-continued
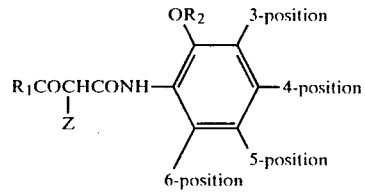
| No. | $R_1$ | $R_2$ | Z | Substituted position on aromatic ring 3 | 4 | 5 | 6 |
|---|---|---|---|---|---|---|---|
| Y-9 | (t)$C_4H_9$— | —$CH_3$ | 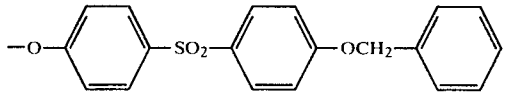 | —H | —H | 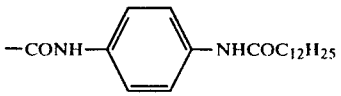 | —H |
| Y-10 | (t)$C_4H_9$— | —$C_{12}H_{25}$ | 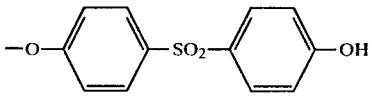 | —H | —H | —CONH$CH(CH_3)CH_2SO_2C_2H_5$ | —H |
| Y-11 | (t)$C_4H_9$— | —$C_{18}H_{37}$ | 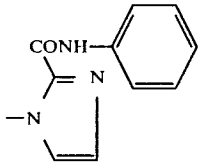 | —H | —H | —NHCO$C(CH_3)_2CH_2SO_2C_4H_9$ | —H |
| Y-12 | (t)$C_4H_9$— | —$CH_3$ | 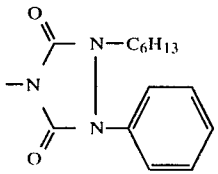 | —H | —H | 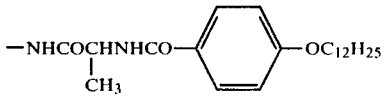 | —H |
| Y-13 | (t)$C_4H_9$— | —$C_4H_9$ | 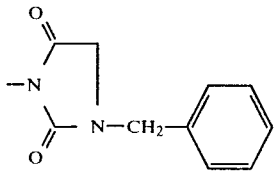 | —H | —H | 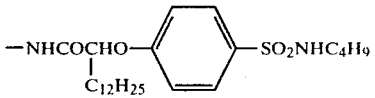 | —H |

-continued
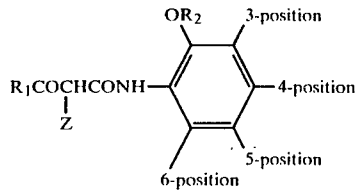
| No. | $R_1$ | $R_2$ | Z | Substituted position on aromatic ring: 3 | 4 | 5 | 6 |
|---|---|---|---|---|---|---|---|
| Y-14 | (t)$C_4H_9$— | —$CH_3$ | 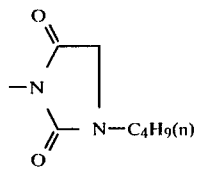 | —H | —H | —NHCO(CH$_3$)CH$_2$SO$_2$C$_{12}$H$_{25}$ | —H |
| Y-15 | (t)$C_4H_9$— | —$CH_3$ | 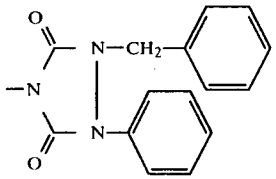 | —H | —H | —CONH(CH$_2$)$_2$NHSO$_2$C$_{12}$H$_{25}$ | —H |
| Y-16 | (t)$C_4H_9$— | —$CH_3$ | 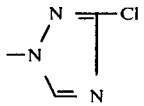 | —H | —H | —CONH(CH$_3$)CH$_2$SO$_2$CH$_2$CH($C_6H_{13}$)$C_8H_{17}$ | —H |
| Y-17 | (t)$C_4H_9$— | —$CH_3$ | 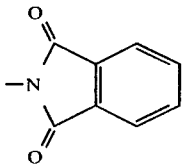 | —H | —H | —SO$_2$NH(CH$_2$)$_3$O—($C_5H_{11}$(t))—$C_5H_{11}$(t) | —H |

-continued
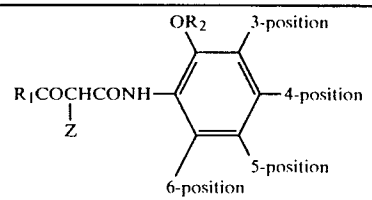
| No. | $R_1$ | $R_2$ | Z | Substituted position on aromatic ring 3 | 4 | 5 | 6 |
|---|---|---|---|---|---|---|---|
| Y-18 | (t)$C_4H_9$— | —$CH_3$ | 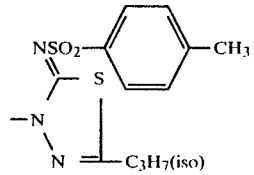 | —H | —H | 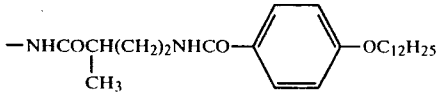 | —H |
| Y-19 | $CH_3$ / $C_2H_5OCH_2C$— / $CH_3$ | —$CH_3$ | 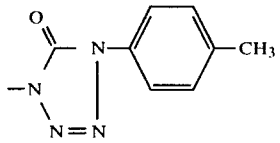 | —H | —H | —$NHCO(CH_2)_{10}COOC_2H_5$ | —H |
| Y-20 | (t)$C_4H_9$— | —$CH_3$ | 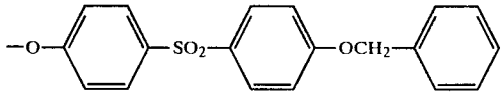 | —H | —H | 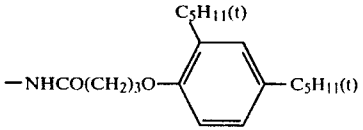 | —H |
| Y-21 | (t)$C_4H_9$— | —$CH_3$ | 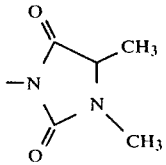 | —H | —H | —$NHCOCHCH_2SO_2C_{12}H_{25}$ / $CH_3$ | —H |
| Y-22 | (t)$C_4H_9$— | —$CH_3$ | 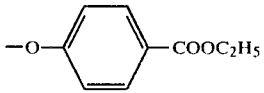 | —H | —H | 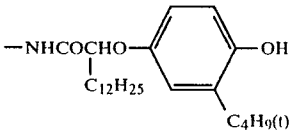 | —H |

-continued
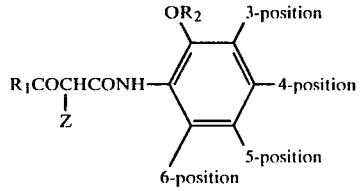
| No. | $R_1$ | $R_2$ | Z | Substituted position on aromatic ring 3 | 4 | 5 | 6 |
|---|---|---|---|---|---|---|---|
| Y-23 | (t)$C_4H_9$— | —$C_{12}H_{25}$ | 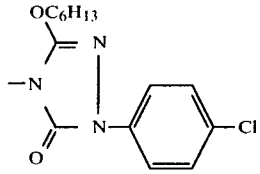 | —H | —H | —$NHCO(CH_2)_2SO_2NHCH_2CH(C_2H_5)C_4H_9$ | —H |
| Y-24 | (t)$C_4H_9$— | —$C_2H_5$ | 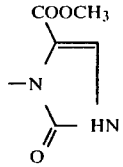 | —H | —H | 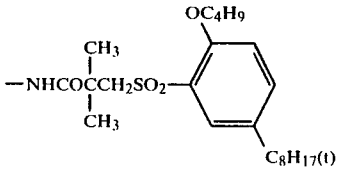 | —H |
| Y-25 | 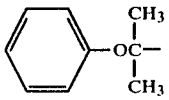 | —$C_4H_9$ | 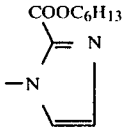 | —H | —H | —$NHSO_2C_{16}H_{33}$ | —H |
| Y-26 | (t)$C_5H_{11}$ | —$C_2H_5$ | —H | —H | —H | 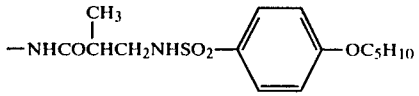 | —H |
| Y-27 | (t)$C_4H_9$— | —$CH_3$ | 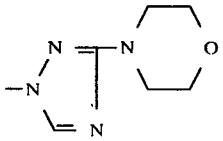 | —H | —H | 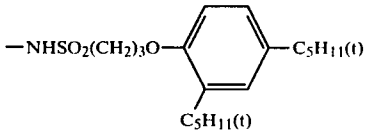 | —H |

-continued
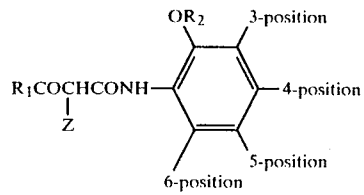
| No. | $R_1$ | $R_2$ | Z | Substituted position on aromatic ring: 3 | 4 | 5 | 6 |
|---|---|---|---|---|---|---|---|
| Y-28 | (t)$C_4H_9$— | —$C_{18}H_{37}$ | 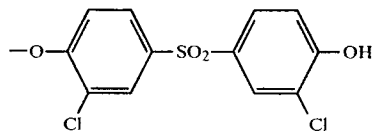 | —H | —H | —$NHCO(CH_2)_2NHSO_2N$—$CH_3$ 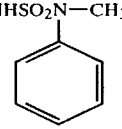 | —H |
| Y-29 | (t)$C_4H_9$— | —$CH_3$ | 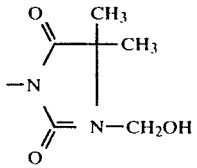 | —H | —H | —$CONH(CH_2)_4NHCO$— 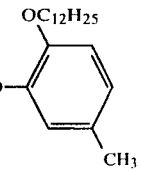 | —H |
| Y-30 | (t)$C_4H_9$— | —$CH_3$ | 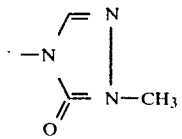 | —H | —H | —$CONHCH(C_6H_{13})CH_2SO_2NHC_{12}H_{25}$ | —H |
| Y-31 | (t)$C_4H_9$— | —$CH_3$ | 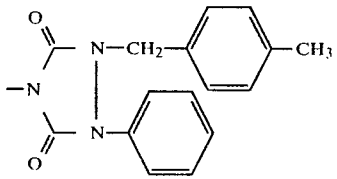 | —H | —H | —$COOC_{12}H_{25}$ | —H |

-continued
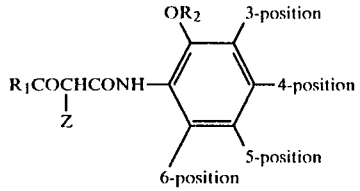
| No. | $R_1$ | $R_2$ | Z | Substituted position on aromatic ring: 3 | 4 | 5 | 6 |
|---|---|---|---|---|---|---|---|
| Y-32 | 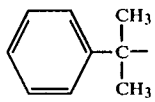 | $-C_{12}H_{25}$ | 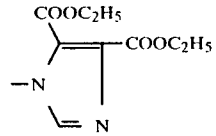 | —H | —H | $-NHCO(CH_2)_3NHCONHCH_2CH(C_2H_5)C_4H_9$ | —H |
| Y-33 | $(t)C_5H_{11}-$ | $-CH_3$ | 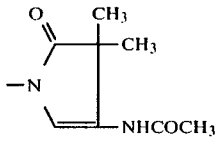 | —H | —H | 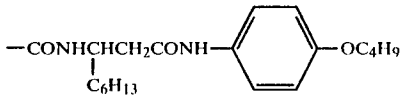 | —H |
| Y-34 | $(t)C_4H_9-$ | $-CH_3$ | 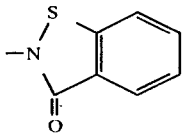 | —H | —H | $-COOC_{18}H_{35}$ | —H |
| Y-35 | $(t)C_4H_9-$ | $-CH_3$ | 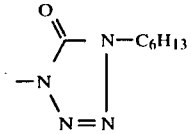 | —H | —H | $-NHCO(CH_2)_3NHCOCH_2CH(C_8H_{17})C_6H_{13}$ | —H |
| Y-36 | $(t)C_4H_9-$ | $-CH_3$ | 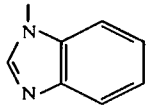 | —H | —Cl | $-NHCOC(CH_3)_2CH_2NHCON(C_{12}H_{25})(C_2H_5)$ | —H |

-continued
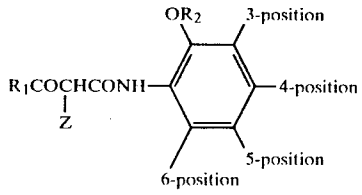
| No. | $R_1$ | $R_2$ | Z | Substituted position on aromatic ring: 3 | 4 | 5 | 6 |
|---|---|---|---|---|---|---|---|
| Y-37 | (t)$C_4H_9$— | 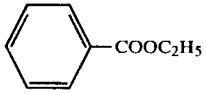 | 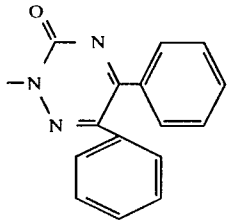 | —H | —H | 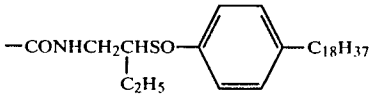 | —H |
| Y-38 | (t)$C_4H_9$— | —$C_4H_9$ | 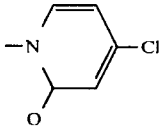 | —H | —NHCOCHSO$_2$NHC$_{12}$H$_{25}$ \| C$_{16}$H$_{33}$ | —Cl | —H |
| Y-39 | (t)$C_4H_9$— | —$CH_3$ | 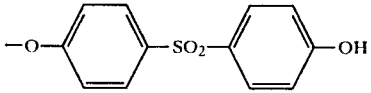 | —H | —Cl | 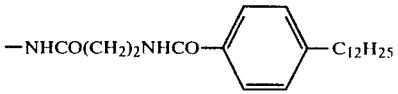 | —H |
| Y-40 | (t)$C_4H_9$— | 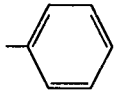 | 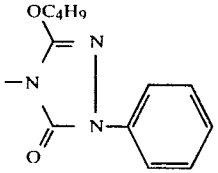 | —H | —H | 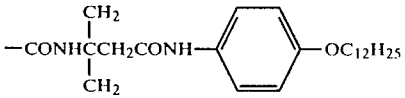 | —H |

-continued
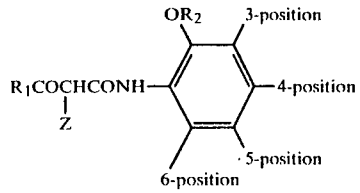
| No. | $R_1$ | $R_2$ | Z | Substituted position on aromatic ring: 3 | 4 | 5 | 6 |
|---|---|---|---|---|---|---|---|
| Y-41 | (t)$C_5H_{11}$ | $-\overset{O}{\overset{\|\|}{C}}CH_3$ | 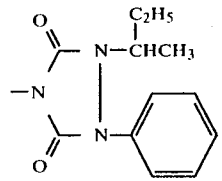 | —H | —$OCH_3$ | 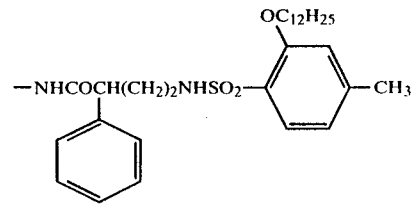 | —H |
| Y-42 | (t)$C_4H_9$— | $-\overset{O}{\overset{\|\|}{C}}C_2H_5$ | 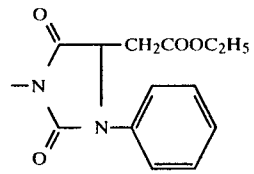 | —H | —H | —$COOCH(CH_3)COOC_{12}H_{25}$ | —H |
| Y-43 | (t)$C_4H_9$— | —$CH_3$ | 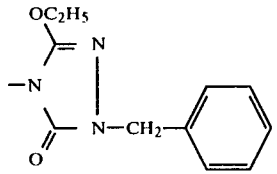 | —H | —H | 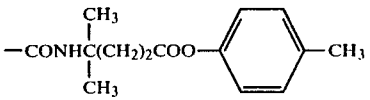 | —H |
| Y-44 | (t)$C_4H_9$— | —$CH_3$ | 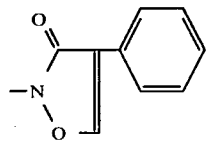 | —H | —$CONH(CH_2)_4NHSO_2CH(CH_3)C_4H_9$ | —$OCH_3$ | —H |

-continued
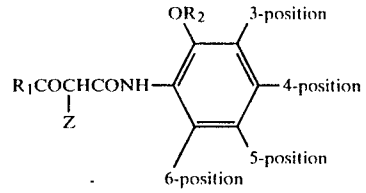
| No. | $R_1$ | $R_2$ | Z | Substituted position on aromatic ring: 3 | 4 | 5 | 6 |
|---|---|---|---|---|---|---|---|
| Y-45 | (t)$C_4H_9$— | —$CH_3$ | 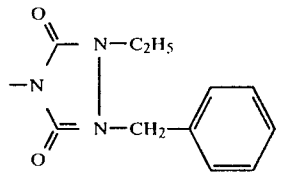 | —H | —H | 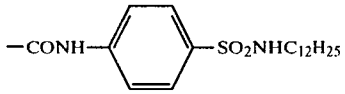 | —H |
| Y-46 | (t)$C_4H_9$— | —$CH_3$ | 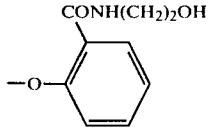 | —H | —H | —COOCH(C$_4$H$_9$)COOC$_{12}$H$_{25}$ | —H |
| Y-47 | (t)$C_4H_9$— | —$CH_3$ | 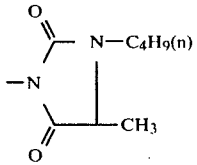 | —H | —H | —NHCO(CH$_3$)CH$_2$SO$_2$C$_{12}$H$_{25}$ | —H |
| Y-48 | 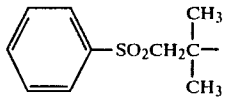 | —$C_2H_5$ | 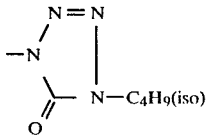 | —H | —H | 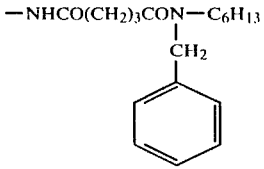 | —H |

-continued
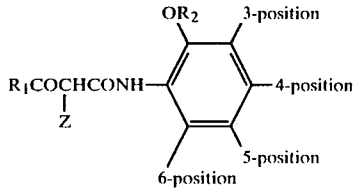
| No. | $R_1$ | $R_2$ | Z | Substituted position on aromatic ring: 3 | 4 | 5 | 6 |
|---|---|---|---|---|---|---|---|
| Y-49 | (t)$C_4H_9$— | 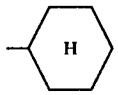 | 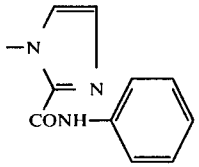 | —H | —H | 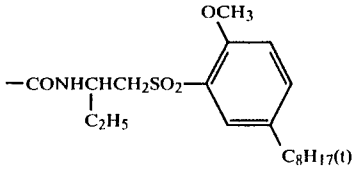 | —H |
| Y-50 | 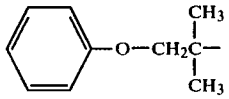 | —$CH_3$ | 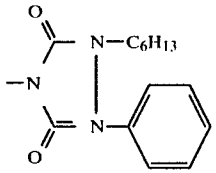 | —H | —H | —CONHCHCOOC$_{12}$H$_{25}$ \| $C_2H_5$ | —H |
| Y-51 | (iso)$C_3H_7$— | —$C_4H_9$ | 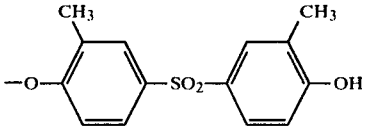 | —H | —H | 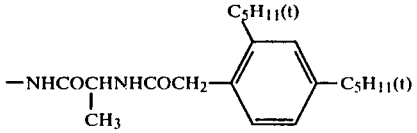 | —H |
| Y-52 | 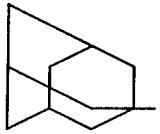 | —$CH_3$ | 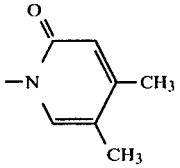 | —H | —H | —NHCO(CH$_2$)$_{10}$COOC$_2$H$_5$ | —H |

-continued
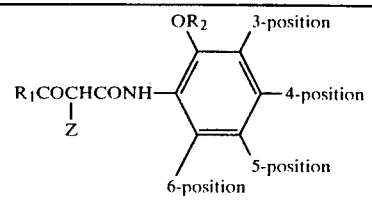
| No. | $R_1$ | $R_2$ | Z | Substituted position on aromatic ring 3 | 4 | 5 | 6 |
|---|---|---|---|---|---|---|---|
| Y-53 | 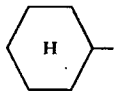 | $-CH_3$ | 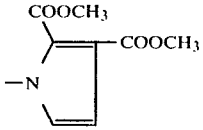 | —H | —H | 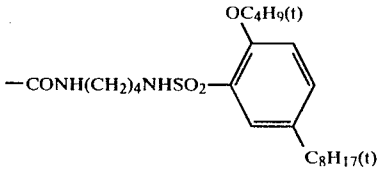 | —H |
| Y-54 | 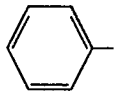 | $-CH_3$ | 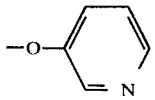 | —H | —H | 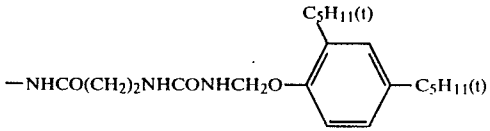 | —H |
| Y-55 | $(t)C_4H_9-$ | $-C_{16}H_{33}$ | 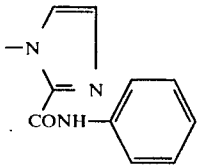 | —H | —H | $-SO_2NHCOC_2H_5$ | —H |

As the color developing agent to be used in the color developer of the present invention, aminophenol type compounds and p-phenylenediamine type compounds may be included, but in the present invention, p-phenylenediamine type compounds having water soluble group are preferred.

Such water soluble group may be at least one possessed on amino group or benzene nucleus of p-phenylenediamine type compound, and specific water soluble groups may include:

$-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_nC_mH_{2m+1}$ (m and n each represent an integer of 0 or more), —COOH group, $-SO_3H$ group as preferable ones.

Specific exemplary compounds of the color developing agent preferably used in the present invention are set forth below.

[Exemplary color developing agents]

(A-1)

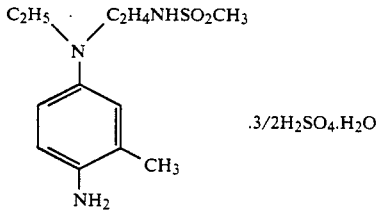

(A-2)

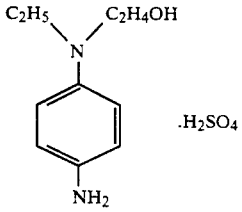

(A-3)

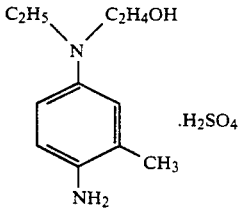

(A-4)

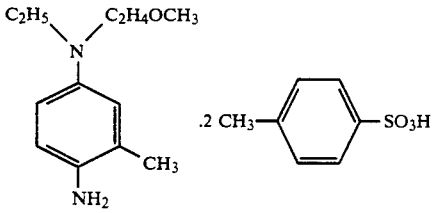

(A-5)

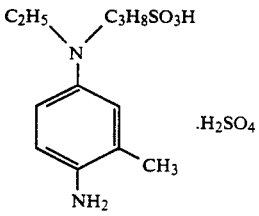

-continued

[Exemplary color developing agents]

(A-6)

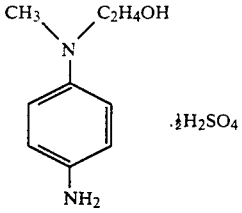

(A-7)

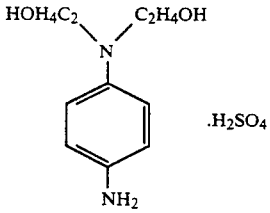

(A-8)

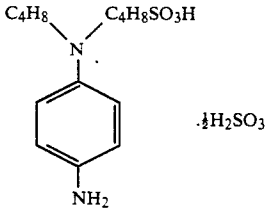

(A-9)

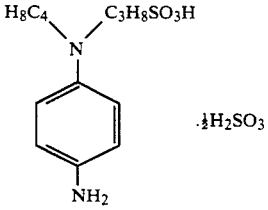

(A-10)

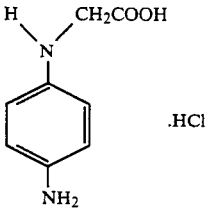

(A-11)

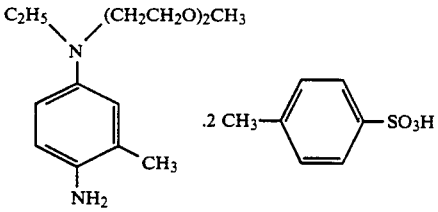

(A-12)

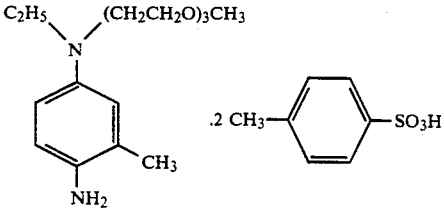

-continued

[Exemplary color developing agents]

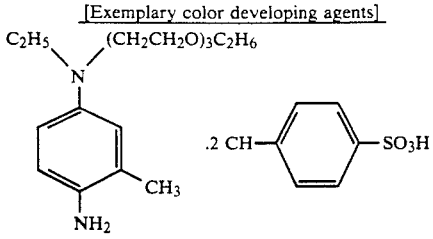

(A-13)

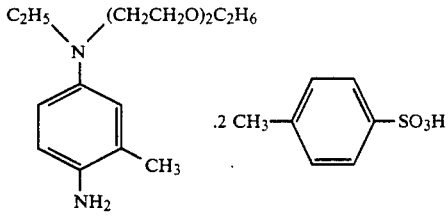

(A-14)

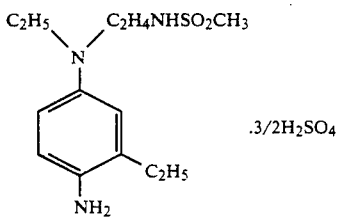

(A-15)

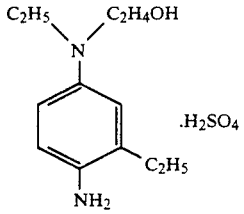

(A-16)

Of the color developing agents as exemplified above, preferably used in the present invention are compounds represented by exemplary No. (A-1), (A-2), (A-3), (A-4), (A-6), (A-7) and (A-15), particularly No. (A-1).

The above color developing agent is normally used in the form of a salt such as hydrochloride, sulfate, p-toluene-sulfonate, etc.

The color developing agent to be used in the present invention should be preferably in the range from $1.0\times10^{-2}$ to $2.0\times10^{-1}$ mole, more preferably from $1.5\times10^{-2}$ to $2.0\times10^{-1}$ mole, per one liter of color developer.

In the present invention, the above color developer can be used as any desired pH region, but from the stand-point of rapid processing, pH 9.5 to 13.0 is preferable, more preferably 9.8 to 12.0.

In the present invention, the processing temperature of the color developing step is from about 30° C. to 50° C., and the higher temperature is preferable as rapid processing is possible. The temperature is preferably not too high as it effects image storage stability and is more preferably from about 33° C. to 45° C.

The processing time may be preferably 20 seconds to 5 minutes, more preferably 30 seconds to 2 minutes.

The amount of the color developer replenished may be 20 to 150 ml/m$^2$ (light-sensitive material), preferably 20 to 120 ml/m$^2$, more preferably 20 to 100 ml/m$^2$.

In the color developer of the present invention, in addition to the above components, the following developing solution components can be contained.

As the alkali agent, there can be employed, for example, sodium hydroxide, potassium hydroxide, silicates, sodium metaborates, potassium metaborate, trisodium phosphate, tripotassium phosphate, borax, etc., either singly or in combination. Further, from necessity in preparation, for the purpose of making ionic strength higher, etc., various salts such as disodium hydrogen phosphate, dipotassium hydrogen phosphate, sodium bicarbonate, potassium bicarbonate, borates, etc. can be used.

Also, if desired, inorganic or organic antifoggants can be added.

Further, if desired, developing accelerators can be also used. As developing accelerators, there may be included various pyridinium compounds, other cationic compounds, cationic dyes such as phenosafranine, neutral salts such as thallium nitrate as represented by U.S. Pat. Nos. 2,648,604, 3,671,247, Japanese Patent Publication No. 9503/1969, polyethylene glycols and derivatives thereof, nonionic compound such as polythioethers, etc. disclosed in U.S. Pat. Nos. 2,533,990, 2,531,832, 2,950,970, 2,577,127 and Japanese Patent Publication No. 9504/1969, organic solvents and organic amines disclosed in Japanese Patent Publication No. 9509/1969, ethanol amine, ethylenediamine, diethanolamine, triethanolamine, etc. Also, there may be included phenethyl alcohols described in U.S. Pat. No. 2,304,925, and otherwise acetylene glycol, methyl ethyl ketone, cyclohexanone, thioethers, pyridine, ammonium, hydrazine, amines, etc.

In the present invention, it is not preferable to use benzyl alcohol. To efficiently accomplish the objects of the present invention it is preferable not to use poorly soluble organic solvents represented by the above mentioned phenethyl alcohol. Use of them in a color developer over a long term will readily result in generation of tar in running processing particularly in low replenishing system, and such generation of tar may even bring about vital trouble that its commercially value may be markedly damaged by attachment onto a paper light-sensitive material to be processed.

Further, in the color developer of the present invention, if necessary, ethylene glycol, methyl cellosolve, methanol, acetone, dimethylformamide, $\beta$-cyclodextrin, and otherwise the compounds described in Japanese Patent Publication Nos. 33378/1972, 9509/1969 can be used as the organic solvent for enhancing the solubility of the developing agent.

Further, an auxiliary developing agent can be also used together with the developing agent. As these auxiliary developing agents, for example, N-methyl-p-aminophenol hexasulfate (Metol), phenidone, N,N'-diethyl-p-aminophenol hydrochloride, N,N,N',N'-tetramethyl-p-phenylenediamine hydrochloride, etc. have been known, and the amount to be added may be generally preferably 0.01 g to 1.0 g/liter.

Further, otherwise, various additives such as anti-staining agents, sludge preventives, interlayer effect accelerators, etc. can be used.

Also, in the color developer of the present invention, various chelating agents may be added, for example, diethylenetriaminepentaacetic acid, ethylenediaminetetraacetic acid, nitrilotriacetic acid, ethylenediaminetetramethylenephosphonic acid, tripolyphosphoric acid, hexametaphosphoric acid, 1-hydroxyethylidene-1,1-diphosphonic acid, etc.

The light-sensitive material of the present invention after the above-described color developing processing is subjected to bleaching processing which bleaches the silver image developed with a bleaching solution, and the fixing processing which desilverizes with a fixing solution. Also, the light-sensitive material of the present invention is also preferably subjected to bleach-fixing processing after the above-described color developing processing. More specifically, the bleach-fixing processing is the step of forming changing the metallic silver formed by developing to a silver halide by oxidation with a bleaching agent, and subsequently forming a water soluble complex simultaneously with color formation of the non-color formed portion of the color forming agent.

The bleaching agent to be used in the bleaching solution or bleach-fixing solution is a metal complex of an organic acid. The complex is an organic acid such as aminopolycarboxylic acid or oxalic acid, citric acid, etc coordinated with metal ions of iron, cobalt, copper, etc As the most preferable organic acid for forming such metal complex of organic acid, polycarboxylic acids may be employed. These polycarboxylic acids or aminopolycarboxylic acids may be also alkali metal salts, ammonium salts or water soluble amine salts. Specific examples of these may include those as shown below.

[1] Ethylenediaminetetraacetic acid
[2] Diethylenetriaminepentaacetic acid
[3] Ethylenediamine-N-(β-oxyethyl)-N,N'N'-triacetic acid
[4] Propylenediaminetetraacetic acid
[5] Nitrilotriacetic acid
[6] Cyclohexanediaminetetraacetic acid
[7] Iminodiacetic acid
[8] Dihydroxyethylglycinecitric acid (or tartaric acid)
[9] Ethyl ether diaminetetraacetic acid
[10] Glycol ether diaminetetraacetic acid
[11] Ethylenediaminetetrapropionic acid
[12] Phenylenediaminetetraacetic acid
[13] Disodium ethylenediaminetetraacetate
[14] Tetra(trimethylammonium) ethylenediaminetetraacetate
[15] Tetrasodium ethylenediaminetetraacetate
[16] Pentasodium diethylenetriaminepentaacetate
[17] Sodium ethylenediamine-N-(β-oxyethyl)-N,N'N'-triacetate
[18] Sodium propylenediaminetetraacetate
[19] Sodium nitriloacetate
[20] Sodium cyclohexandiaminetetraacetate
[21] Diethylenetriaminepentamethylenephosphonic acid
[22] Cyclohexanediaminetetramethylenephosphonic acid These bleaching agents may be used in amounts of 5 to 450 g/liter, more preferably 20 to 250 g/liter, more particularly preferably 25 to 100 g/liter.

In the bleaching solution or bleach-fixing solution, sulfites can be contained as the preservative, if necessary.

Also, in the bleaching solution or bleach-fixing solution, various bleaching accelerators can be added, as described in Japanese Unexamined Patent Publication No. 280/1971, Japanese Patent Publication Nos. 8506/1970, 556/1971, Belgian Patent No. 770,910, Japanese Patent Publications Nos. 8836/1970, 9854/1978, Japanese Unexamined Patent Publications Nos. 71634/1979 and 42349/1974, etc.

In the fixing solution or bleach-fixing solution, a silver halide fixing agent is contained. Representative as such silver halide fixing agent, are compounds which form water soluble complexes through the reaction with silver halides employed in conventional fixing processing, as exemplified by thiosulfates such as potassium thiosulfate, sodium thiosulfate, ammonium thiosulfate, thiocyanates such as potassium thiocyanate, sodium thiocyanate, ammonium thiocyanate, or thiourea, thioether, etc. These fixing agents can be employed in amounts of 5 g/liter or more and within the soluble range, but generally in amounts of 70 g to 250 g/liter.

In the bleaching solution, the fixing solution, the bleach-fixing solution, pH buffer comprising boric acid, borax, sodium hydroxide, potassium hydroxide, sodium carbonate, potassium carbonate, sodium bicarbonate, potassium bicarbonate, acetic acid, sodium acetate, ammonium hydroxide, and other various salts can be contained either singly or in combination of two or more kinds. Further, various fluorescent brighteners, defoaming agents or surfactants can be also contained. Also, there can be suitably contained preservatives such as hydroxylamine, hydrazine, bisulfurous acid adducts of aldehyde compounds, organic chelating agents such as aminopolycarboxylic acids, etc. or stabilizers such as nitroalcohol, nitrate, etc., organic solvents such as methanol, dimethyl sulfoamide, dimethyl sulfoxide, etc.

The pH of the bleaching-fixing solution may be 4.0 or higher, generally 4.0 to 9.5, desirably 4.5 to 8.5, most preferably 5.0 to 8.0.

The processing temperature may be 80° C. or lower, more preferably 55° C. or lower, and used while suppressing vaporization,etc.

The processing time of bleach-fixing should be preferably 120 seconds or shorter, more preferably 5 to 90 seconds.

As the processing steps after the fixing processing or bleach-fixing processing, various processings such as water washing processing, stabilizing processing, stabilizing processing substituting for water washing, rinsing, etc. can be performed, and there can be included, for example, those disclosed in Japanese Unexamined Patent Publications Nos.8542/1982, 126533/1984, 220345/1985, 75451/1987, 85628/1988, 138349/1988, 244036/1988 and Published Technical Report No. 87-1984, etc.

As the magenta coupler to be used in the present invention, pyrazolone type, pyrazolotriazole type, pyrazolinobenzimidazole, indazolone type compounds may be included. As the pyrazolone type magenta coupler may be employed the compounds described in U.S. Pat. Nos. 2,600,788, 3,062,653, 3,127,269, 3,311,476, 3,419,391, 3,519,429, 3,558,319, 3,684,514, 3,888,680, Japanese Unexamined Patent Publications Nos. 29639/1974, 111631/1974, 129538/1974, 13041/1975, 47167/1978, 10491/1979, 30615/1980; as the pyrazolotriazole type magenta coupler, compounds described in U.S. Pat. No. 1,247,493, Belgian Patent 792,525; as the diffusion resistant colored magenta coupler, generally compounds arylazo-substituted at the coupling position of colorless magenta couplers, such as compounds described in U.S. Pat. Nos. 2,801,171, 2,983,608, 3,005,712, 3,684,514, U.K. Patent 937,621, Japanese Unexamined Patent Publications Nos. 123625/1974, 31448/1974.

As the preferable magenta coupler in the present invention, the compounds represented by the formula (M-I) shown below are preferred.

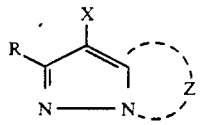

Formula (M-I)

In the formula, Z represents a group of non-metallic atoms necessary for formation of a nitrogen containing heterocyclic group, and the ring formed by said Z may also have a substituent.

X represents hydrogen atom or a group eliminable through the reaction with the oxidized product of a color developing agent.

R represents hydrogen atom or a substituent.

The substituent represented by R is not particularly limited, but representative examples may include respective groups of alkyl, aryl, anilino, acylamino, sulfonamide, alkylthio, arylthio, alkenyl, cycloalkyl, etc. but otherwise, there may be also included halogen atoms, and respective groups of cycloalkenyl, alkynyl, heterocyclic, sulfonyl, sulfinyl, phosphonyl, acyl, carbamoyl, sulfamoyl, cyano, alkoxy, aryloxy, heterocyclicoxy, siloxy, acyloxy, carbamoyloxy, amino, alkylamino, imide, ureido, sulfamoylamino, alkoxycarbonylamino, aryloxycarbonylamino, alkoxycarbonyl, aryloxycarbonyl, heterocyclicthio, as well as spiro compound residues, bridged hydrocarbon compound residues.

As the alkyl group represented by R, those having 1 to 32 carbon atoms are preferable, which may be either straight or branched.

As the aryl group represented by R, phenyl group is preferable.

As the acylamino group represented by R, alkylcarbonylamino group, arylcarbonylamino group, etc. may be included.

As the sulfonamide group represented by R, alkylsulfonylamino group, arylsulfonylamino group, etc. may be included.

As the alkyl component, aryl component in the alkylthio group, arylthio group represented by R, the alkyl group, aryl groups as mentioned above for R may be included.

Preferable as the alkenyl group represented by R are those having 2 to 32 carbon atoms, as the cycloalkyl group those having 3 to 12, particularly 5 to 7 carbon, and the alkenyl group may be either straight or branched.

As the cycloalkenyl group represented by R, those having 3 to 12, particularly 5 to 7 carbon atoms are preferred.

As the sulfonyl group represented by R may be included alkylsulfonyl group, arylsulfonyl group, etc.;

as the sulfinyl group, alkylsulfinyl group, arylsulfinyl group, etc.;

as the phosphonyl group, alkylphosphonyl group, alkoxyphosphonyl group, aryloxyphosphonyl group, arylphosphonyl group, etc.;

as the acyl group, alkylcarbonyl group, arylcarbonyl group, etc.;

as the carbamoyl group, alkylcarbamoyl group, arylcarbamoyl group, etc.;

as the sulfamoyl group, alkylsulfamoyl group, arylsulfamoyl group, etc.;

as the acyloxy group, alkylcarbonyloxy group, arylcarbonyloxy group, etc.;

as the carbamoyloxy group, alkylcarbamoyloxy group, arylcarbamoyloxy group, etc.;

as the ureido group, alkylureido group, arylureido group, etc.;

as the sulfamoylamino group, alkylsulfamoylamino group, arylsulfamoylamino group, etc.;

as the heterocyclic group, those of 5- to 7-membered rings, specifically 2-furyl group, 2-thienyl group, 2-pyrimidinyl group, 2-benzothiazolyl group, etc.;

as the heterocyclicoxy group, those having 5- to 7-membered heterocyclic rings, such as 3,4,5,6-tetrahydropyranyl-2-oxy group, 1-phenyltetrazol-5-oxy group, etc.;

as the heterocyclicthio group, 5- to 7-membered heterocyclicthio group, such as 2-pyridylthio group, 2-benzothiazolylthio group, 2,4-diphenoxy-1,3,5-triazol-6-thio group, etc.;

as the siloxy group, trimethylsiloxy group, triethylsiloxy group, dimethylbutylsiloxy group, etc.;

as the imide group, succinimide group, 3-heptadecylsuccinimide group, phthalimide group, glutarimide group, etc.;

as the spiro compound residue, spiro[3,3]heptan-1-yl, etc.;

bridged hydrocarbon residue such as bicyclo[2.2.1-]heptan-1-yl, tricyclo[3.3.1.13,7]decan-1-yl, 7,7-dimethylbicyclo[2.2.1]heptan-1-yl, etc.

As the group eliminable through the reaction with the oxidized product of a color developing agent represented by X, for example, there may be included halogen atoms (chlorine, bromine, fluorine atoms) and respective groups of alkoxy, aryloxy, heterocyclicoxy, acyloxy, sulfonyloxy, alkoxycarbonyloxy, aryloxycarbonyl, alkyloxazolyloxy, alkoxyoxazolyloxy, alkylthio, arylthio, heterocyclicthio, alkyloxycarbonylthio, acylamino, sulfonamide, nitrogen containing heterocyclic ring bonded through N atom, alkyloxy-carbonylamino, aryloxycarbonyl-amino, carboxyl,

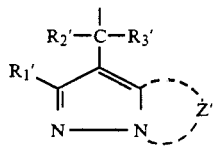

($R_1'$ is the same as the above R, Z' is the same as the above Z, $R_2'$ and $R_3'$ represent hydrogen atom, aryl group, alkyl group or heterocyclic group), etc., preferably halogen atoms, particularly chlorine atom.

As the nitrogen containing heterocyclic ring formed by Z or Z', pyrazole ring, imidazole ring, triazole ring or tetrazole ring, etc. may be included, and as the substituent which may be possessed by the above-mentioned ring, those as described above for R may be included.

More specifically, those represented by the formula (M-I) may be represented by the following formulae (M-II) to (M-VII).

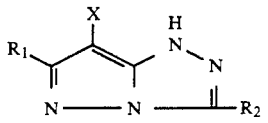

Formula (M-II)

-continued

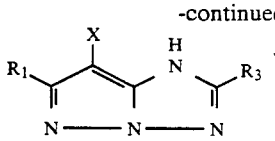

Formula (M-III)

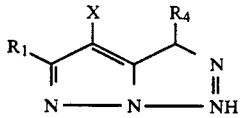

Formula (M-IV)

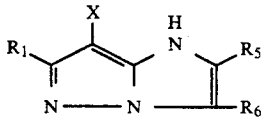

Formula (M-V)

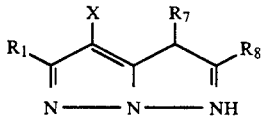

Formula (M-VI)

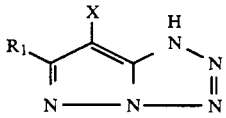

Formula (M-VII)

In the above formulae (M-II) to (M-VII), $R_1$ to $R_8$ and X have the same meanings as the above R and X.

Of the compounds of the formula (M-I), preferable are those represented by the following formula (M-VIII):

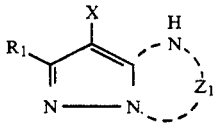

Formula (M-VIII)

wherein $R_1$, X and $Z_1$ have the same meanings as R, X and Z in the formula (M-I).

Among the magenta couplers represented by the above formulae (M-II) to (M-VII), particularly preferable are magenta couplers represented by the formula (M-II).

As the substituents R and $R_1$ on the above heterocyclic ring, most preferable are those represented by the following formula (M-IX):

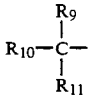

Formula (M-IX)

In the formula, $R_9$, $R_{10}$ and $R_{11}$ have the same meanings as the above R.

Also, two of the above $R_9$, $R_{10}$ and $R_{11}$, for example $R_9$ and $R_{10}$ may be bonded to form a saturated or unsaturated ring (e.g. cycloalkane, cycloalkene, heterocyclic ring), and further $R_{11}$ may be bonded to said ring to form a bridged hydrocarbon compound residue.

Of the compounds of the formula (M-IX), preferable are (i) the case when at least two of $R_9$ to $R_{11}$ are alkyl groups, (ii) the case when at least one of $R_9$ to $R_{11}$, for example, $R_{11}$ is hydrogen atom, and the other two $R_9$ and $R_{10}$ are bonded to form a cycloalkyl together with the root carbon atom.

Further preferable of (i) is the case when two of $R_9$ to $R_{11}$ are alkyl groups, and the other one is hydrogen atom or an alkyl group.

As the substituent which may be possessed by the ring formed by Z in the formula (M-I) and the ring formed by $Z_1$ in the formula (M-VIII), and as $R_2$ to $R_8$ in the formulae (M-II) to (M-VI), those represented by the formula (M-X) are preferred.

$$-R^1-SO_2-R^2. \qquad \text{Formula (M-X)}$$

In the formula, $R^1$ represents an alkylene group, $R^2$ an alkyl group, cycloalkyl group or aryl group.

The alkylene group represented by $R^1$ may preferably have 2 or more, more preferably 3 to 6 carbon atoms at the straight portion, and may be either straight or branched.

As the cycloalkyl group represented by $R^2$, those of 5- to 6-membered rings are preferable.

In the following, representative specific examples of the magenta coupler to be used in the present invention are set forth.

[Exemplary compounds]

1

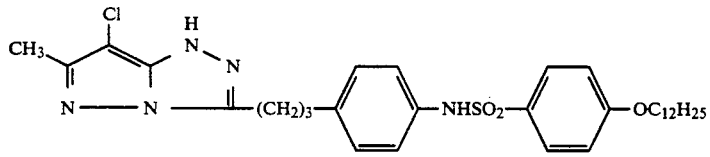

3

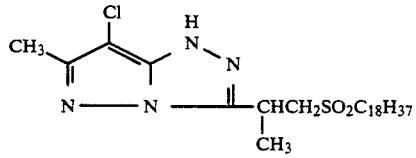

4

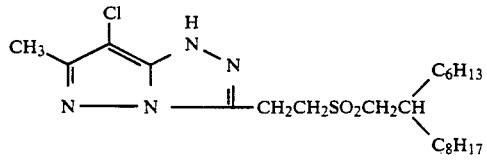

-continued
[Exemplary compounds]
5
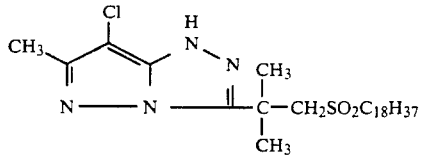
6
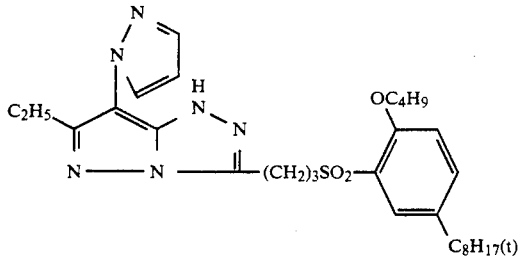
7
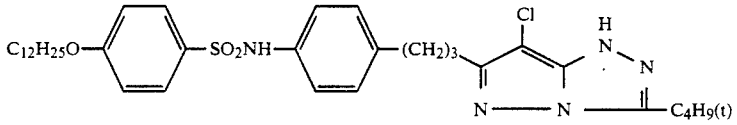
8
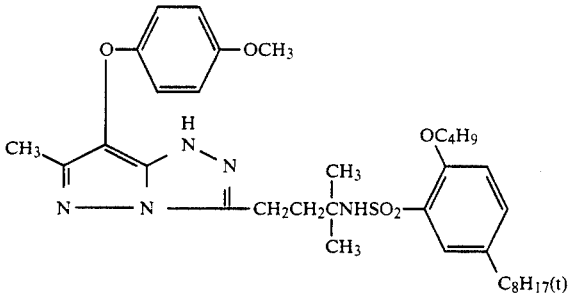
9
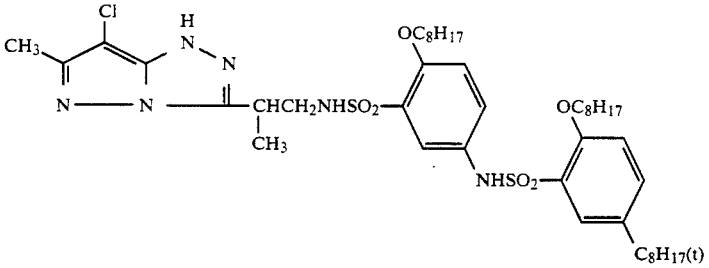
10
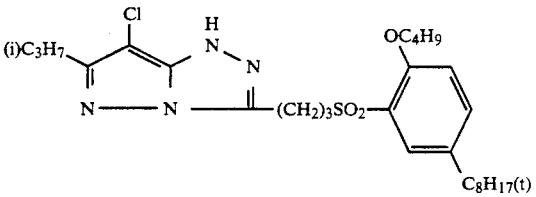
11
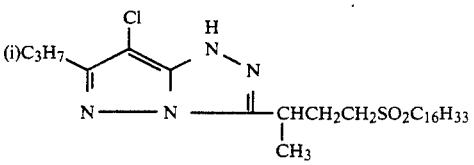

-continued
[Exemplary compounds]
12
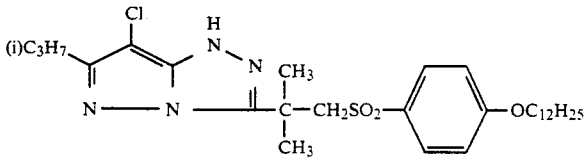
13
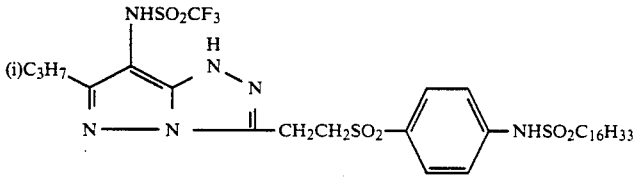
14
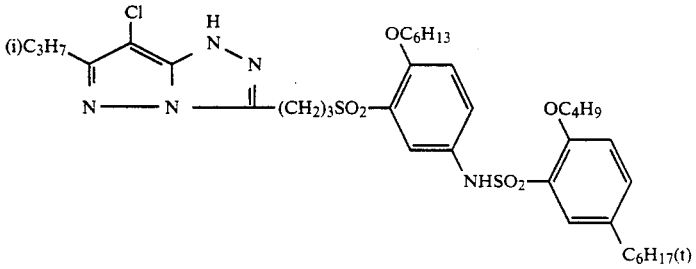
15
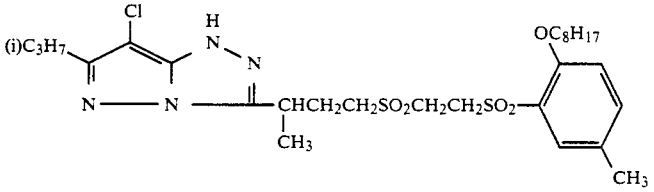
16
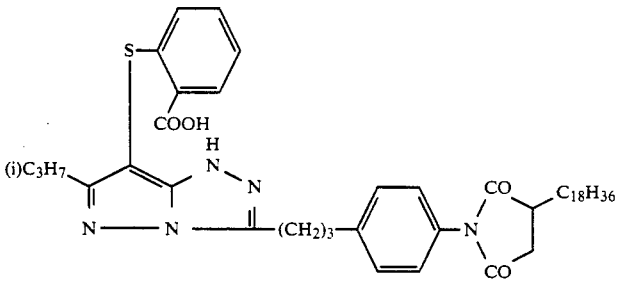
17
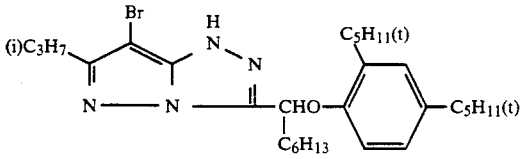
18
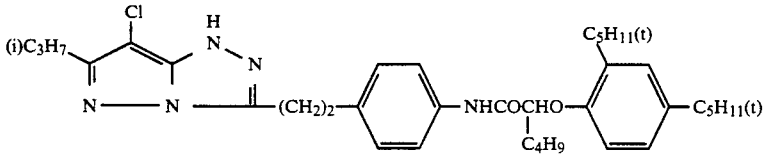
19
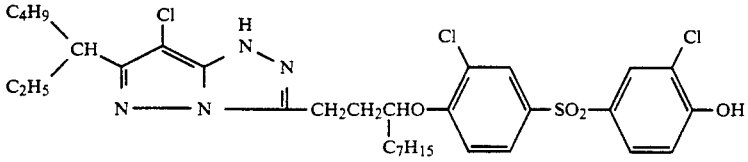

-continued
[Exemplary compounds]
20
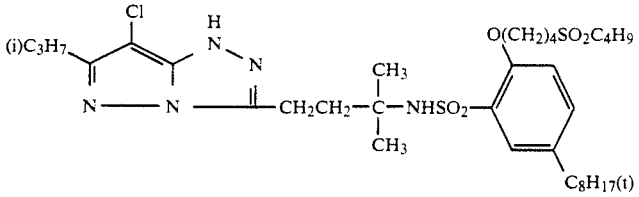
21
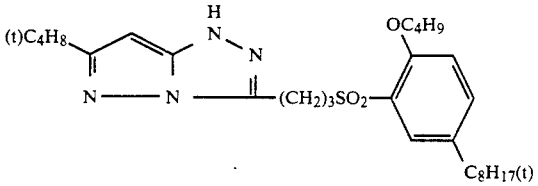
22
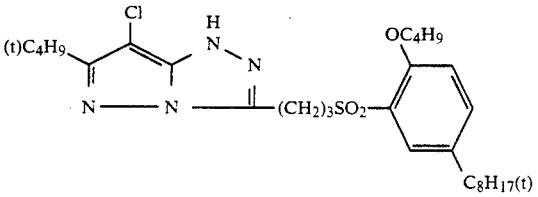
23
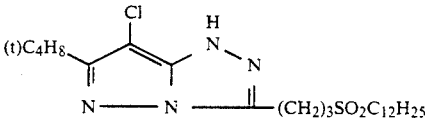
24
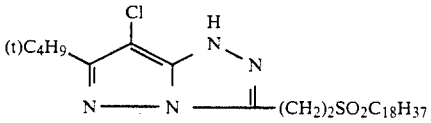
25
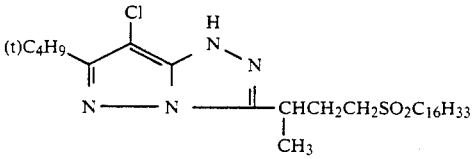
26
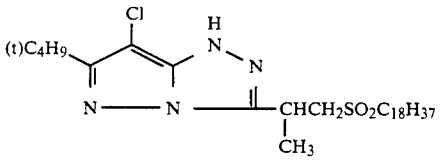
27
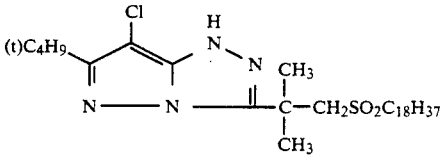
28
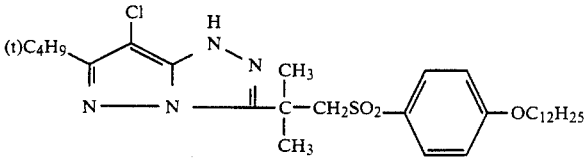

-continued
[Exemplary compounds]
30
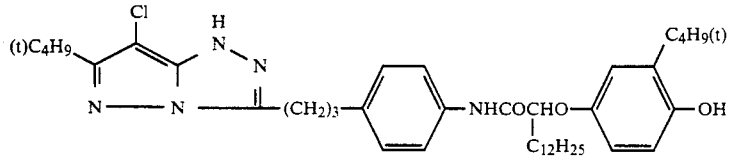
31
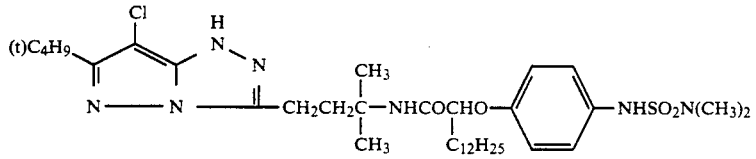
33
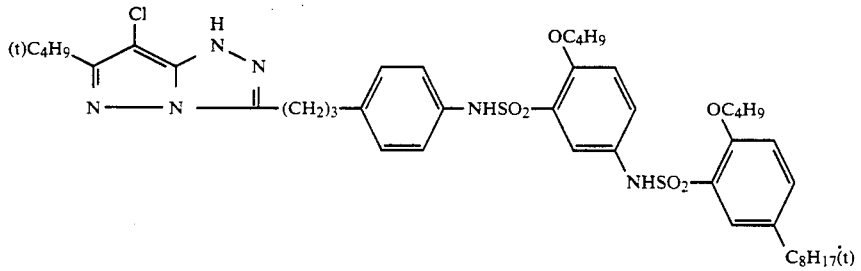
34
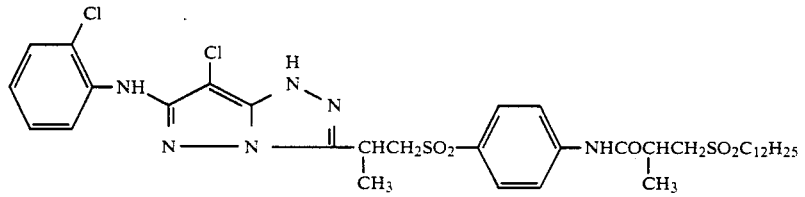
35
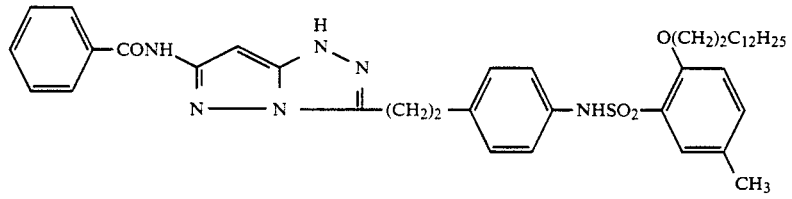
36
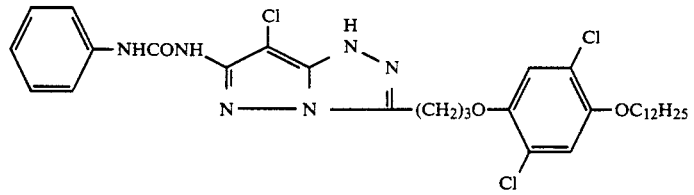
37
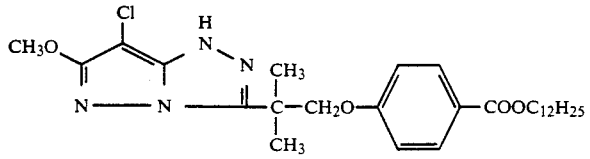

-continued
[Exemplary compounds]
38
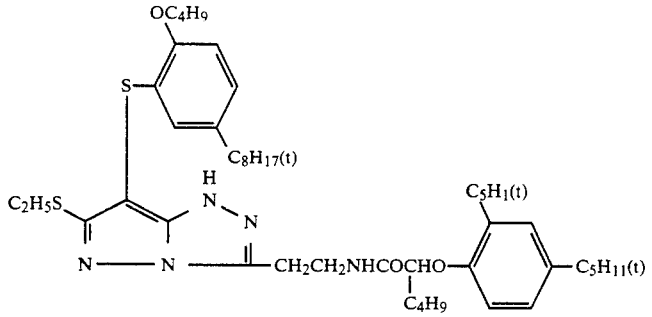
39
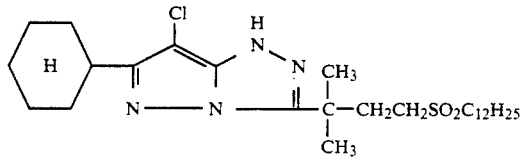
40
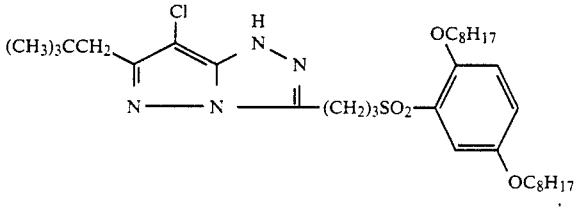
41
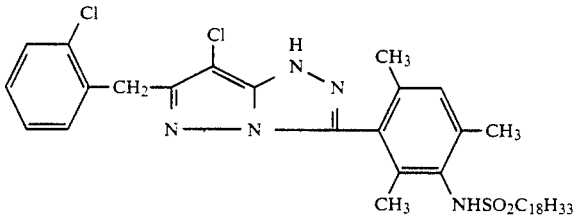
43
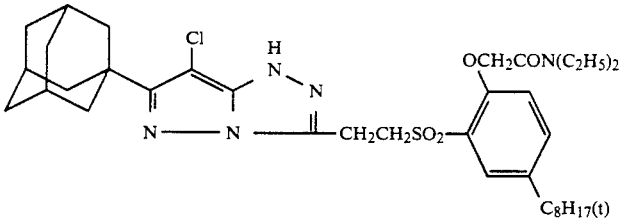
44
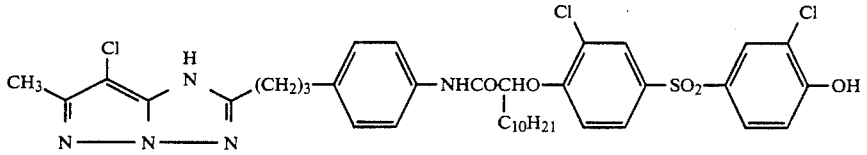
45
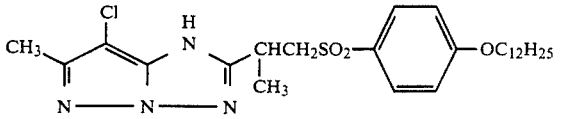

-continued
[Exemplary compounds]
46
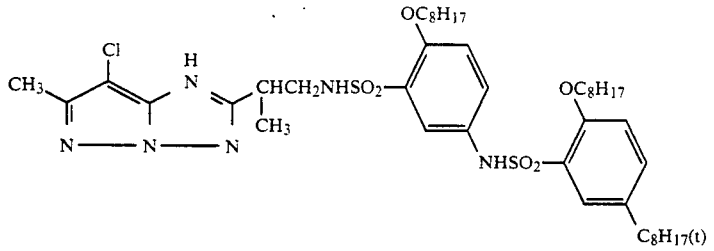
47
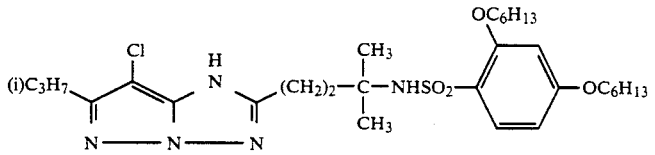
48
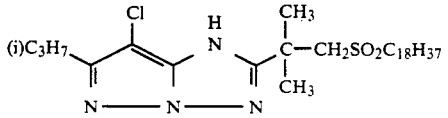
49
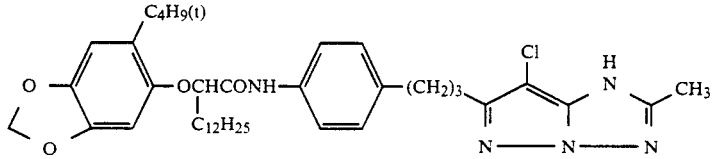
50
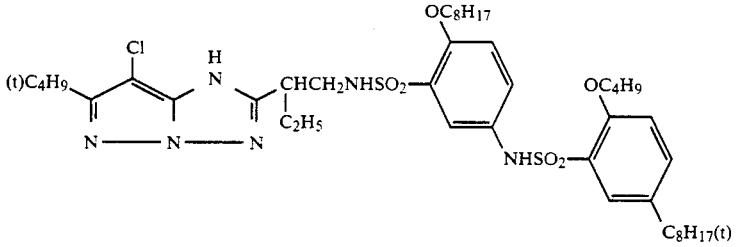
51
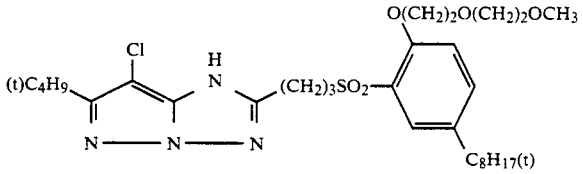
52
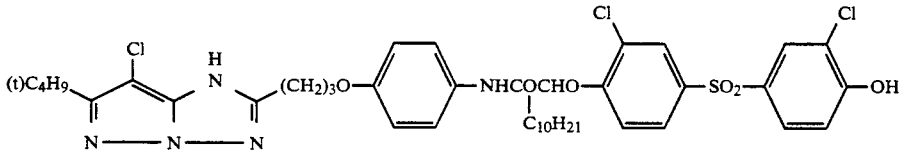
53
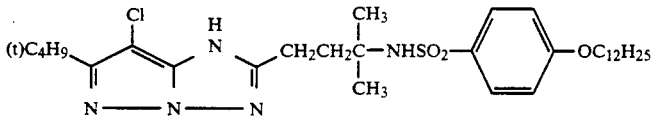
54
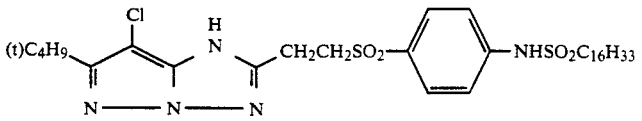

-continued
[Exemplary compounds]
55
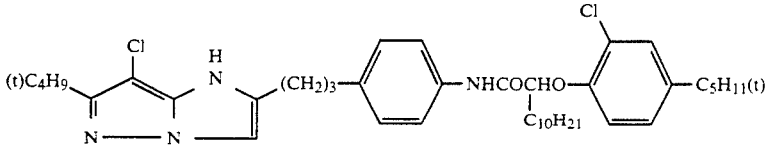
56
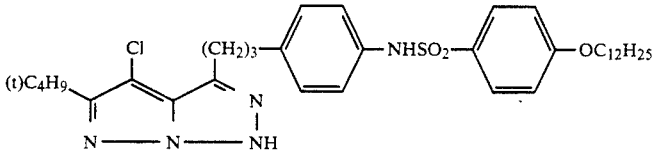
57
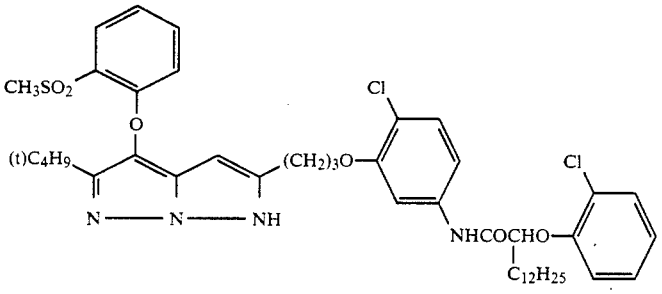
58
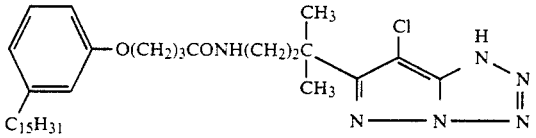
59
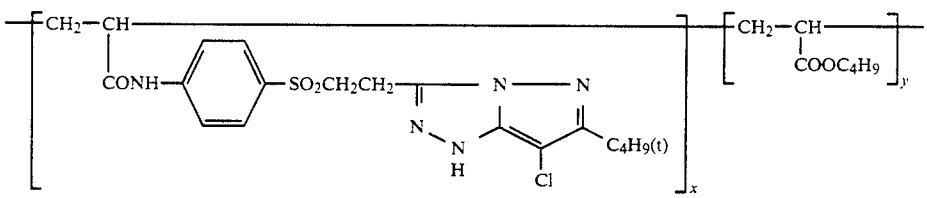
x:y = 50:50 (weight ratio)
60
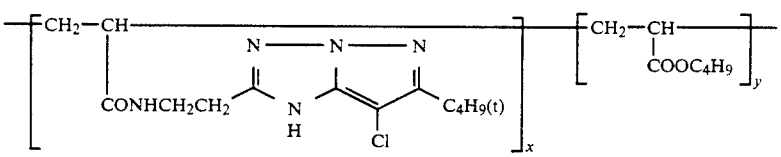
x:y = 50:50 (weight ratio)
61
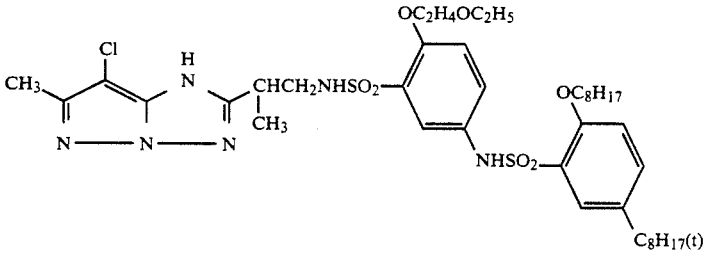
2
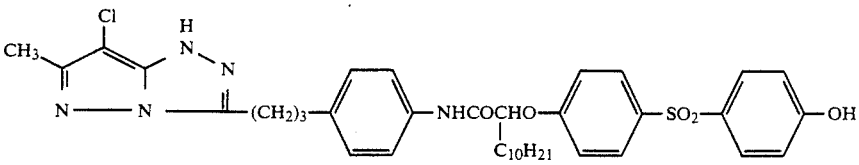

-continued

[Exemplary compounds]

29

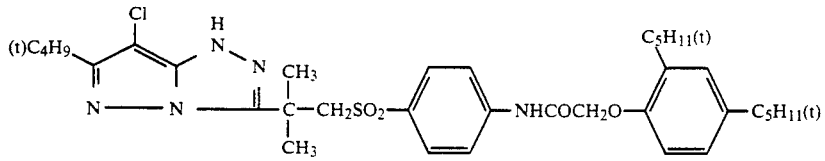

32

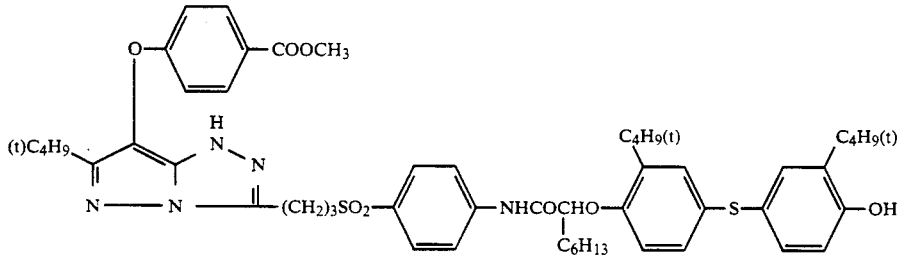

42

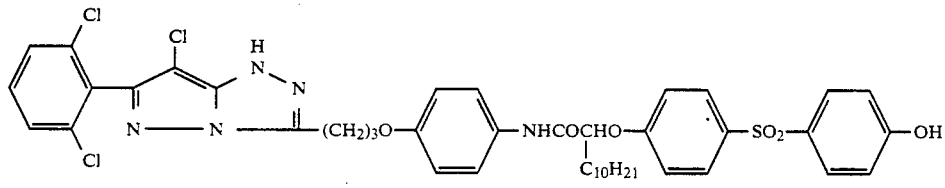

In addition to the representative specific examples of the compounds to be used in the present invention, specific examples of the compounds according to the present invention may include the compounds represented by No. 1 to 4, 6, 8 to 17, 19 to 24, 26 to 43, 45 to 59, 61 to 104, 106 to 121, 123 to 162, 164 to 223 among the compounds described on pages 66 to 122 in Japanese Patent Application No. 9791/1986.

The above-mentioned couplers can be synthesized with reference to Journal of the Chemical Society, Perkin I (1977), 2047-2052, U.S. Pat. No. 3,725,067, Japanese Unexamined Patent Publications Nos. 99437/1984, 42045/1983, 162548/1984, 171956/1984, 33552/1985, 43659/1985, 172982/1985 and 190779/1985.

The magenta coupler can be used generally in an amount ranging from $1\times10^{-3}$ mole to 1 mole, preferably $1\times10^{-2}$ mole to $8\times10^{-1}$ mole, per 1 mole of silver halide.

The magenta coupler to be used in the present invention can be also used as a combination of the compound of the formula (Y-I) with another kind of magenta coupler.

As the cyan coupler to be used in the present invention, phenol type compounds, naphthol type compounds are preferable, can be selected from those described in U.S. Pat. Nos. 2,369,929, 2,434,272, 2,474,293, 2,895,826, 3,253,924, 3,034,892, 3,311,476, 3,386,301, 3,419,390, 3,458,315, 3,476,563, 3,531,383, etc., and also the synthetic method of those compounds are described in the same patents.

As the cyan coupler to be used in the present invention, particularly preferable are cyan couplers represented by the following formula (C-I).

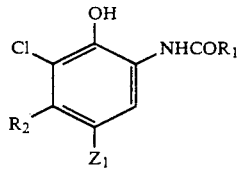

Formula (C-I)

In the formula, $R_1$ represents a ballast group, $R_2$ an alkyl group having 2 or more carbon atoms. $Z_1$ represents hydrogen atom or an atom or group eliminable through the reaction with the oxidized product of a color developing agent.

In the above formula (C-I), the alkyl group represented by $R_2$ may be either straight or branched, and is inclusive also of those having substituents. $R_2$ may be preferably an alkyl group having 2 to 6 carbon atoms.

The ballast group represented by $R_1$ is an organic group having a size and a shape which give sufficient bulkiness to coupler molecules to prevent substantially diffusion of the coupler from the layer to which the coupler is applied to other layers.

Preferable as the ballast group are those represented by the following formula:

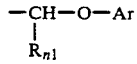

(C-I-A)

$R_{n1}$ represents an alkyl group having 1 to 12 carbon atoms, Ar an aryl group such as phenyl group, etc., and the aryl group is also inclusive of those having substituents.

In the following, specific examples of the coupler represented by the formula (C-I) are shown, but these are not limitative of the invention.

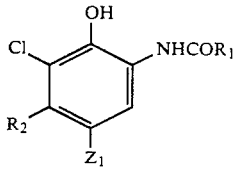
| Coupler No | $R_2$ | $Z_1$ | $R_1$ |
|---|---|---|---|
| C-I-1 | $-C_2H_5$ | $-Cl$ | 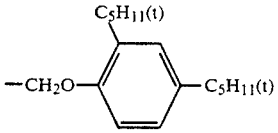 |
| C-I-2 | $-C_2H_5$ | 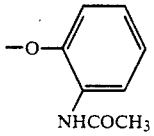 | 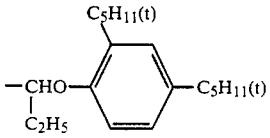 |
| C-I-3 | $-C_3H_7(i)$ | $-Cl$ | 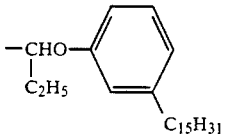 |
| C-I-4 | $-C_2H_5$ | $-Cl$ | 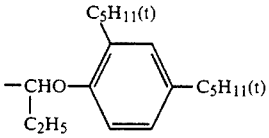 |
| C-I-5 | $-C_4H_9$ | $-F$ | 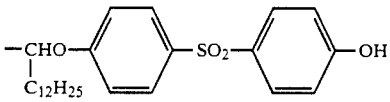 |
| C-I-6 | $-C_2H_5$ | $-F$ | 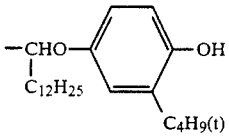 |
| C-I-7 | $-C_2H_5$ | $-Cl$ | 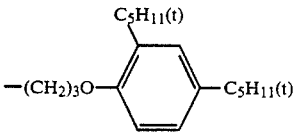 |
| C-I-8 | $-C_2H_5$ | $-Cl$ | 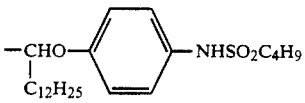 |
| C-I-9 | $-C_2H_6$ | $-Cl$ | 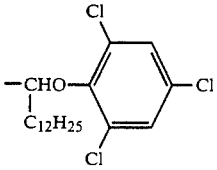 |

-continued
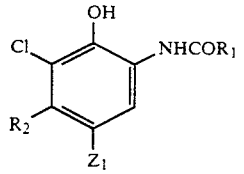
| Coupler No | $R_2$ | $Z_1$ | $R_1$ |
|---|---|---|---|
| C-I-10 | $-C_6H_{13}$ | $-Cl$ | 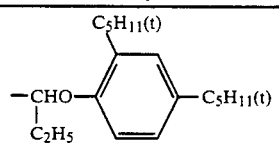 |
| C-I-11 | $-C_3H_7$ | $-Cl$ | 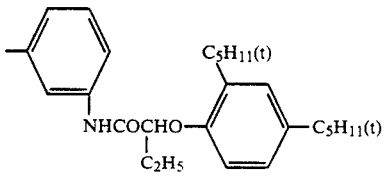 |
| C-I-12 | $-C_2H_4NHCOCH_3$ | $-Cl$ | 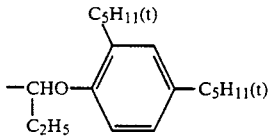 |
| C-I-13 | $-(CH_2)_2OCH_3$ | $-Cl$ | 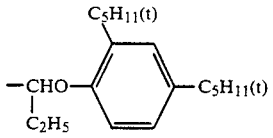 |
| C-I-14 | $-C_2H_5$ | $-Cl$ | 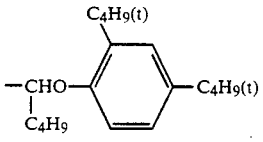 |
| C-I-15 | $-C_4H_9(t)$ | $-OCH_2CH_2-SO_2CH_3$ | 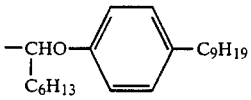 |
| C-I-16 | $-C_2H_5$ | $-Cl$ | 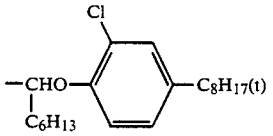 |
| C-I-17 | $-C_2H_5$ | $-Cl$ | 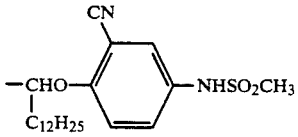 |
| C-I-18 | $-C_2H_5$ | $-Cl$ | 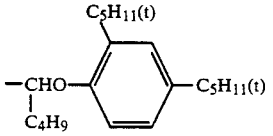 |
Including these, specific examples of the cyan coupler which can be used in the present invention are The cyan coupler represented by the above formula (C-I) of the present invention can be used in an amount generally in the range from $1\times10^{-3}$ mole to 1 mole, preferably from $1\times10^{-2}$ mole to $8\times10^{-1}$ mole, per one mole of silver halide.

The compounds such as dye forming couplers in the light-sensitive silver halide photographic material of the present invention are generally dissolved in a high boiling organic solvent with a boiling point of 150° C. or higher or a water insoluble polymer by using a low boiling and/or water soluble organic solvent in combination, emulsified in a hydrophilic binder such as an aqueous gelatin solution by use of surfactants, and then added in the desired hydro-philic colloidal layer. It may be also possible to incorporate the step of removing the dispersion or the low boiling organic solvent simultaneously with dispersing.

The high boiling organic solvent may be preferably a compound having a dielectric constant of 6.5 or lower, as exemplified by esters such as phthalate, phosphate, etc., organic acid amides, ketones, hydrocarbon compounds, etc. with a dielectric constant of 6.5 or lower. Further preferably, high boiling organic solvents with a dielectric constant of 6.5 or lower and 1.9 or higher, and a vapor pressure at 100° C. of 0.5 mm Hg or lower may be employed. Among these, more preferable are phthalates or phosphates. Most preferably, dialkylphthalates having alkyl group with 9 or more carbon atoms may be employed. Further, the high boiling organic solvent may be a mixture of 2 or more kinds.

The dielectric constant indicates that at 30° C.

These high boiling organic solvents may be used generally at a ratio of 0 to 400% by weight based on the coupler. Preferably, it may be 10 to 100% by weight based on the coupler.

The light-sensitive silver halide photographic material of the present invention can be, for example, nega of color nega and posi film, and also color printing paper, etc., but above all the effects of the present invention can be exhibited when used for color printing paper provided for direct viewing.

The light-sensitive silver halide photographic material of the present invention, typically such color printing paper, may be either for monochromatic use or for multi-color use.

As the silver halide to be used in the light-sensitive silver halide photographic material of the present invention, any one conventionally used in silver halide emulsion can be used, such as silver bromide, silver iodobromide, silver iodochloride, silver chlorobromide and silver chloride, etc.

The silver halide grains to be used in the present invention containing preferably 90 mole % or more of silver chloride, further preferably 10 mole % or less of silver bromide, and 0.5 mole % or less of silver iodide. Further preferably, a silver chlorobromide with a silver bromide content of 0.1 to 2 mole % may be employed.

The silver halide grains may be employed either singly or as a mixture with other silver halide grains with different compositions. Also, it may be used as a mixture with silver halide grains with a silver chloride content of 90 mole % or less.

In the silver halide emulsion layer containing silver halide grains having a silver chloride content of 90 mole % or more, the ratio of the silver halide grains with a silver chloride content of 90 mole % or more occupied in the total silver halide grains contained in said emulsion layer may be 60% by weight or more, preferably 80% by weight or more.

The silver halide emulsion to be used in the present invention is chemically sensitized according to the sulfur sensitization method, the selenium sensitization method, the reduction sensitization method, the noble metal sensitization method, etc.

The silver halide emulsion to be used in the present invention can be optically sensitized to a desired wavelength region by use of a dye which has been known as the sensitizing dye in the field of photography.

As the binder (or protective colloid) to be used in the present invention, gelatin may be advantageously employed, or otherwise it is possible to use hydrophilic colloids such as gelatin derivatives, graft polymers of gelatin with other polymers, proteins, sugar derivatives, cellulose derivatives, synthetic hydrophilic polymeric substances such as homo- or co-polymers, etc.

The photographic emulsion layer and other hydrophilic colloidal layers in the light-sensitive silver halide photographic material of the present invention can be hardened by using a film hardener which enhances film strength by crosslinking binder (or protective colloid) molecules alone or in combination. The film hardener should be desirably added in an amount which can harden the light-sensitive material to the extent such that no film hardener is required to be added in the processing liquors, but it is also possible to add a film hardener in the processing liquors.

In the light-sensitive silver halide photographic material, in hydrophilic colloidal layers such as protective layer, intermediate layer, etc., for the purpose of preventing fogging by discharging caused by charging of the light-sensitive material by friction, etc., a UV-ray absorber may be also contained for prevention of deterioration of image by UV-ray.

In the light-sensitive silver halide photographic material, auxiliary layers such as filter layer, halation preventive layer and/or irradiation preventive layer, etc. can be provided. In these layers and/or emulsion layers, dyes which flow out from the color sensitive material or are bleached during development processing may be also contained.

In the silver halide emulsion layer and/or other hydrophilic colloidal layer of the light-sensitive silver halide photographic of the present invention, matte agents can be added for the purpose of reducing luster of the light-sensitive material, enhancing writability, and prevent-ing sticking mutually between light-sensitive materials, etc.

The light-sensitive silver halide photographic material of the present invention can add a lubricant therein for reducing sliding friction.

The light-sensitive silver halide photographic material of the present invention can add an antistatic agent therein for the purpose of preventing charging. The antistatic agent may be used in some cases in the antistatic agent layer on the side of the support where no emulsion is laminated, or may be also used in the emulsion layer and/or the protective colloid layer other than the emulsion layer on the side where emulsion layer is laminated on the support.

In the photographic emulsion layer and/or other hydrophilic colloidal layers of the light-sensitive silver halide photographic material, various surfactants may be employed for the purpose of improving coatability, preventing charging, improving slippability, emulsifying, adhesion prevention and improving photographic characteristics (development acceleration, tone hardening, sensitization, etc.), etc.

The photographic emulsion layers and other layers of the light-sensitive silver halide photographic material can be coated on a baryta paper or a paper laminated with an α-olefin polymer, etc. and a paper support of which the paper support and the α-olefin layer can be easily peeled off, a flexible reflective support such as synthetic paper, etc., a film comprising a semi-synthetic or synthetic polymer such as cellulose acetate, cellulose nitrate, polystyrene, polyvinyl chloride, polyethylene terephthalate, polycarbonate, polyamide, etc. and a reflective support coated with a white pigment, a rigid body such as glass, metal, earthenware, etc. Alternatively, a thin type reflective support of 120 to 160 μm can be also used.

The support to be used in the present invention may be either a reflective support or transparent support, and a white pigment may be also contained within the support for imparting reflectivity thereto, or alternatively a hydrophilic colloidal layer containing a white pigment may be also contained on the support.

As the white pigment, inorganic and/or organic white pigments can be used, preferably inorganic white pigments. Examples of such pigments may include sulfates of alkaline earth metals such as barium sulfate, carbonates of alkaline earth metals such as calcium carbonate, silicas such as fine powdery silicic acid, synthetic silicate, etc., calcium silicate, alumina, alumina hydrate, titanium oxide, zinc oxide, talc, clay, etc. White pigments may be preferably barium sulfate, titanium oxide.

The light-sensitive silver halide photographic material may be also applied, if necessary, with corona discharging, Uv-ray irradiation, flame treatment, etc. on the support surface, and may be coated directly or through a subbing layer (1 or 2 or more subbing layers for improvement of adhesion, antistatic property, dimensional stability, abrasion resistance, hardness, halation prevention, frictional characteristics and/or other characteristics).

In coating of the light-sensitive photographic material by use of the silver halide emulsion of the present invention, a thickener may be also used for improvement of coatability. As the coating method, extrusion coating and curtain coating capable of coating two or more kinds of layers at the same time are particularly useful.

Referring now to examples, the present invention is described, but the present invention is not limited at all by these examples.

EXAMPLE 1

On a support having a polyethylene laminated on one surface of a paper support and a polyethylene containing titanium oxide on the first layer side on the other surface, the respective layer with the constitutions shown below were provided by coating to prepare a light-sensitive silver halide color photographic material sample. The coating liquors were prepared as described below.

First Layer Coating Liquor

A solution of 26.7 g of a yellow coupler (Y-3), 10.0 g of a dye image stabilizer (ST-1), 6.67 g of (ST-2), 0.6 g of an anti-staining agent (HQ-1) dissolved in a high boiling organic solvent (DNP) was emulsified into 220 ml of an aqueous 10% gelatin solution containing 7 ml of a 20% surfactant (SU-1) by means of a sonication homogenizer to prepare an yellow coupler dispersion. The dispersion was mixed with a blue-sensitive silver halide emulsion (containing 10 g silver) under the conditions shown below to prepare a first layer coating liquor.

Also, the 2nd to 7th coating liquors were prepared similarly as in the above first layer coating liquor.

| Layer | Constitution | Amount added ($g/m^2$) |
|---|---|---|
| 7th layer (Protective layer) | Gelatin | 1.0 |
| 6th layer (UV-ray absorbing layer | Gelatin | 0.4 |
| | UV-ray absorber (UV-1) | 0.10 |
| | UV-ray absorber (UV-2) | 0.04 |
| | UV-ray absorber (UV-3) | 0.16 |
| | Antistain agent (HQ-1) | 0.01 |
| | DNP | 0.2 |
| | PVP | 0.03 |
| | Anti-irradiation dye (AI-2) | 0.02 |
| 5th layer (Red-sensitive layer) | Gelatin | 1.30 |
| | Red-sensitive silver chlorobromide emulsion (Emc) (in terms of silver) | 0.21 |
| | Cyan coupler (C-1) | 0.17 |
| | Cyan coupler (C-2) | 0.25 |
| | Dye image stabilizer (ST-1) | 0.20 |
| | Antistain agent (HQ-1) | 0.01 |
| | HBS-1 | 0.20 |
| | DOP | 0.20 |
| 4th layer (UV-ray absorbing layer) | Gelatin | 0.94 |
| | UV-ray absorber (UV-1) | 0.28 |
| | UV-ray absorber (UV-2) | 0.09 |
| | UV-ray absorber (UV-3) | 0.38 |
| | Antistain agent (HQ-1) | 0.03 |
| | DNP | 0.40 |
| 3rd layer (Green-sensitive layer) | Gelatin | 1.40 |
| | Green-sensitive silver chlorobromide emulsion (EmB) (in terms of silver) | 0.17 |
| | Magenta coupler (M-1) | 0.35 |
| | Dye image stabilizer (ST-3) | 0.15 |
| | Dye image stabilizer (ST-4) | 0.15 |
| | Dye image stabilizer (ST-5) | 0.15 |
| | DNP | 0.20 |
| | Anti-irradiation dye (AI-1) | 0.01 |
| 2nd layer (Intermediate layer) | Gelatin | 1.20 |
| | Antistain agent (HQ-2) | 0.12 |
| | DIDP | 0.15 |
| 1st layer (Blue-sensitive layer) | Gelatin | 1.20 |
| | Blue-sensitive silver chlorobromide emulsion (EmA) (in terms of silver) | 0.26 |
| | Yellow coupler (Y-1) | 0.80 |
| | Dye image stabilizer (ST-1) | 0.30 |
| | Dye image stabilizer (ST-2) | 0.20 |
| | Antistain agent (HQ-1) | 0.02 |
| | Anti-irradiation dye (AI-3) | 0.01 |
| | DNP | 0.20 |
| Support | Polyethylene-laminated paper | |

Y-3
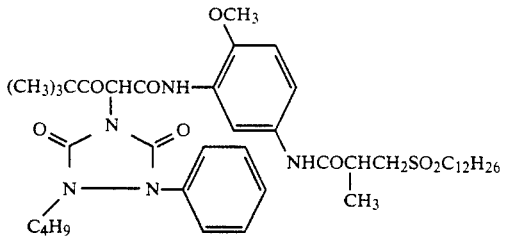
M-1
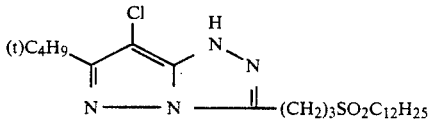
C-1
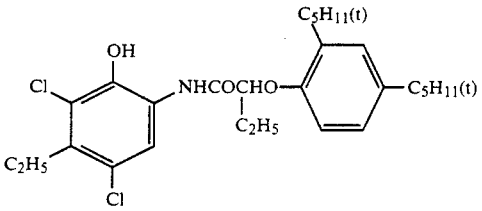
c-2
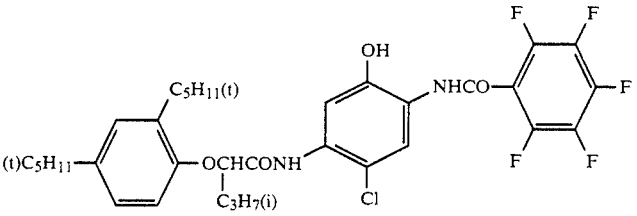
ST-1
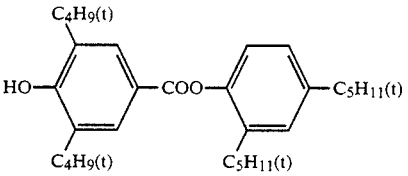
ST-2
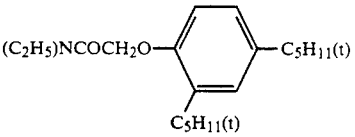
UV-1
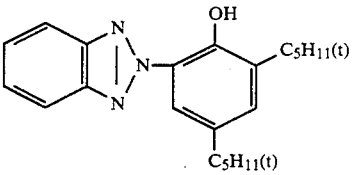
UV-2
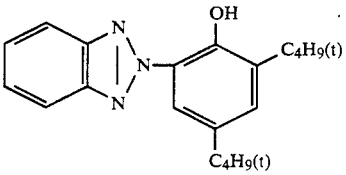

-continued
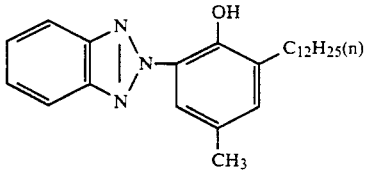
UV-3
DOP dioctylphthalate, DNP dinonylphthalate, DIDP diisodecylphthalate, PVP polyvinylpyrrolidone
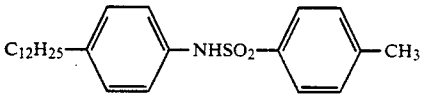
HBS-1
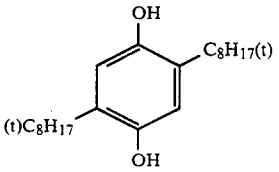
HQ-1
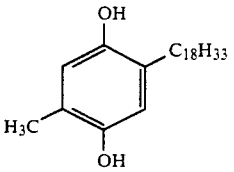
HQ-2
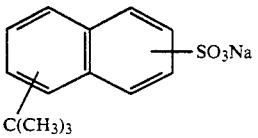
SU-1
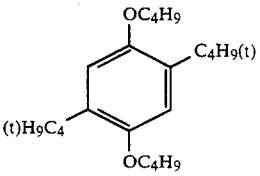
ST-3
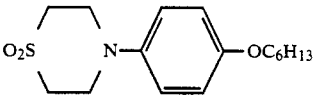
ST-4
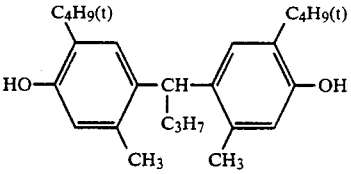
ST-5
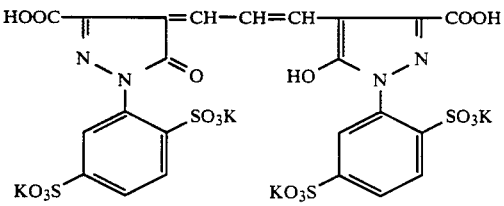
AI-1

-continued

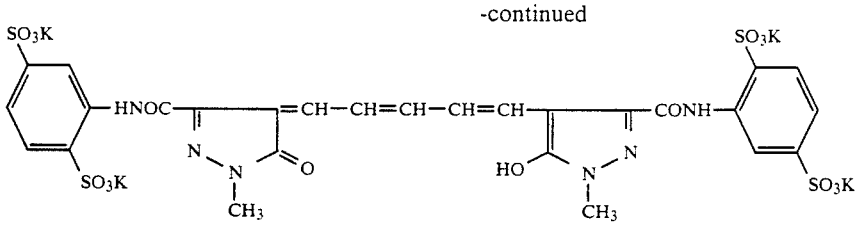

AI-2

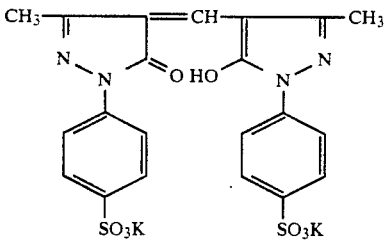

AI-3

As the film hardener, the following H-1 was employed:

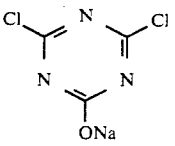

H-1

Method for preparation of blue-sensitive silver halide emulsion

Into 1000 ml of an aqueous 2% gelatin solution maintained at 40° C. were added at the same time (Solution A) and (Solution B) shown below under control of pAg=6.5, pH=3.0 over 30 minutes, and further (Solution C) and (Solution D) shown below were added at the same time under control of pAg=7.3, pH=5.5 over 180 minutes.

At this time, pAg was controlled according to the method described in Japanese Unexamined Patent Publication No. 45437/1984 and pH controlled with the use of an aqueous sulfuric acid or sodium hydroxide solution.

| | |
|---|---|
| (Solution A) | |
| sodium chloride | 3.42 g |
| potassium bromide | 0.03 g |
| water added | to 200 ml |
| (Solution B) | |
| silver nitrate | 10 g |
| water added | to 200 ml |
| (Solution C) | |
| sodium chloride | 102.7 g |
| potassium bromide | 1.0 g |
| water added | to 600 ml |
| (Solution D) | |
| silver nitrate | 300 g |
| water added | to 600 ml |

After completion of addition, the mixture was desalted by use of an aqueous 5% solution of Demol N manufactured by Kao-Atlas and an aqueous 20% solution of magnesium sulfate, and then mixed with an aqueous gelatin solution to obtain a mono-dispersed cubic emulsion EMP-1 with an average grain size of 0.85 μm, a coefficient of fluctuation ($\sigma/\gamma$)=0.07 and a silver chloride content of 99.5 mole %.

The above emulsion EMP-1 was chemically aged by use of the compounds shown below at 50° C. for 90 minutes to obtain a blue-sensitive silver halide emulsion (EmA):

| | |
|---|---|
| sodium thiosulfate | 0.8 mg/mole AgX |
| chloroauric acid | 0.5 mg/mole AgX |
| stabilizer SB-5 | $6 \times 10^{-4}$ mole/mole AgX |
| sensitizing dye D-1 | $5 \times 10^{-4}$ mole/mole AgX. |

Method for preparing green-sensitive silver halide emulsion

In the same manner as in preparation of EMP-1 except for changing, the addition time of (Solution A) and (Solution B) to 10 minutes addition time of (Solution C) and (Solution D) to 120 minutes, a mono-dispersed cubic emulsion EMP-2 with an average grain size of 0.43 μm, a coefficient of fluctuation ($\sigma/\gamma$)=0.08 and a silver chloride content of 99.5 mole % was obtained.

EMP-2 was chemically sensitized by use of the compounds shown below at 55° C. for 120 minutes to obtain a green-sensitive emulsion (EmB):

| | |
|---|---|
| sodium thiosulfate | 1.5 mg/mole AgX |
| chloroauric acid | 1.0 mg/mole AgX |
| stabilizer SB-5 | $6 \times 10^{-4}$ mole/mole AgX |
| sensitizing dye D-2 | $5 \times 10^{-4}$ mole/mole AgX. |

Method for preparing red-sensitive silver halide emulsion

In the same manner as in preparation of EMP-1 except for changing the addition time of (Solution A) and (Solution B) to 15 minutes and the addition time of (Solution C) and (Solution D) to 120 minutes, a mono-dispersed cubic emulsion EMP-3 with an average grain size of 0.50 μm, a coefficient of fluctuation ($\sigma/\gamma$)=0.08 and a silver chloride content of 99.5 mole % was obtained.

EMP-3 was chemically sensitized by use of the compounds shown below at 60° C. for 90 minutes to obtain a red-sensitive emulsion (EmC):

| | |
|---|---|
| sodium thiosulfate | 1.8 mg/mole AgX |
| chloroauric acid | 2.0 mg/mole AgX |
| stabilizer SB-5 | $6 \times 10^{-4}$ mole/mole AgX |

-continued

| | |
|---|---|
| sensitizing dye D-3 | $8.0 \times 10^{-4}$ mole/mole AgX. |

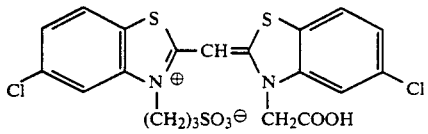

D-1

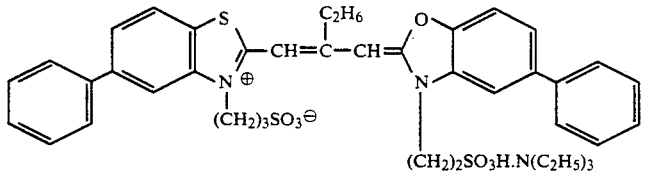

D-2

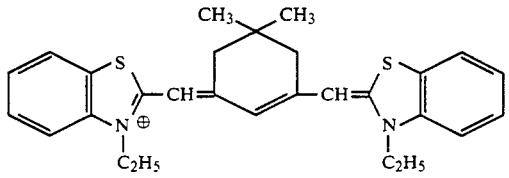

D-3

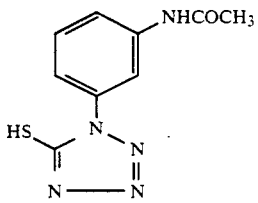

SB-5

| Color developing solution | Tank solution A | Tank solution B | Tank solution C | Replenishing solution A | Replenishing solution B | Replenishing solution C |
|---|---|---|---|---|---|---|
| Pure water (ml) | 800 | 800 | 800 | 800 | 800 | 800 |
| Triethanolamine (g) | 10 | 10 | 10 | 10 | 10 | 10 |
| N,N-diethylhydroxyl amine (g) | 5 | 5 | 5 | 7 | 8 | 9 |
| Potassium chloride (g) | 2 | 2.2 | 2.4 | 0.1 | — | — |
| 1-Hydroxyethylidene-1,1-diphosphonic acid (g) | 1.0 | 1.0 | 1.0 | 1.3 | 1.5 | 1.8 |
| N-ethyl-N-β-methanesulfo namidoethyl-3-methyl-4-aminoaniline sulfate (g) | 5.0 | 5.2 | 5.4 | 7.2 | 7.6 | 8.2 |
| Fluorescent brightener (4,4'-diaminostilbene disulfonic acid derivative) (g) | 1.0 | 1.0 | 1.0 | 1.3 | 1.5 | 1.8 |
| Potassium carbonate (g) | 27 | 27 | 27 | 27 | 27 | 27 |
| Water added to (1) | 1 | 1 | 1 | 1 | 1 | 1 |
| pH | 10.10 | 10.10 | 10.10 | 10.50 | 10.55 | 10.60 |

After exposure of this sample in conventional manner, continuous processing was performed according to the following processing steps until the amount replenished became 3-fold of the tank volume of the color developing solution.

| Processing steps | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30–34° C. | 90 sec. |
| Drying | 60–80° C. | 60 sec. |

The amount of the color developing solution replenished is 160 ml/m² for A, 110 ml/m² for B and 80 ml/m² for C.

| Bleach-fixing solution (tank solution and replenishing solution are the same): | |
|---|---|
| Ferric ammonium ethylenediamine-tetraacetate dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |

The total amount was made up to one liter with addition of water, and the solution adjusted to pH = 5.7 with potassium carbonate or glacial acetic acid.

| Stabilizing solution (tank solution and replenishing solution are the same): | |
|---|---|
| 5-Chloro-2-methyl-4-isothiazolin-3-one | 1.0 g |

-continued

| | |
|---|---|
| Ethylene glycol | 1.0 g |
| 1-Hydroxyethylidene-1,1-diphosphonic acid | 2.0 g |
| Ethylenediaminetetraacetic acid | 1.0 g |
| Ammonium hydroxide (20% aqueous solution) | 3.0 g |
| Fluorescent brightener (4,4'-diaminostilbene disulfonic acid derivative) | 1.5 g |

Table 1-continued

| Constitution | | | Results | | |
|---|---|---|---|---|---|
| Experiment No. | Yellow coupler | Amount Replenished ml/m$^2$ | Change rate of $\Delta D_{650}$(%) | Color reproducibility | Remarks |
| 16 | Y-25 | 80 | 129 | ○ | Inv. |

Comparative yellow coupler (Y-A)

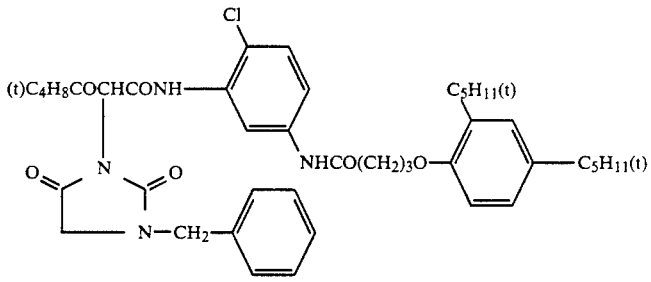

The total amount was made up to one liter with addition of water and the solution adjusted to pH=7.0 with sulfuric acid or potassium hydroxide.

In the above processings, the following tests were conducted before and after each continuous processing.

(1) Spectral absorption characteristics of yellow color developing dye:

By means of a color analyzer (Model 607, Hitachi Seisakusho), the reflection density at 650 nm was measured when the maximum reflection blue density at the yellow color forming portion was 1.0, the difference in reflection density at 650 nm before and after continuous processing ($\Delta D_{650}$) was determined, and the change rates $\Delta D_{650}$ of replenished amounts B and C relative to the $\Delta D_{650}$ of the replenished amount A were determined therefrom.

The results are shown in Table-1.

(2) Color reproducibility

By use of a nega film A obtained by photographing and developing a color chart (Macbeth) by Konica Color GX II 100 (Konica), the image of the print obtained by exposure processing on each example so that the gray portion could be reproduced gray was evaluated according to the following judgement standards:

O: image without turbidity at image portion

Δ: image with slight turbidity seen at image portion

×: image with turbidity at image portion.

The results are shown in Table-1.

Table 1

| Constitution | | | Results | | |
|---|---|---|---|---|---|
| Experiment No. | Yellow coupler | Amount Replenished ml/m$^2$ | Change rate of $\Delta D_{650}$(%) | Color reproducibility | Remarks |
| 1 | Y-A | 110 | 203 | x | Control |
| 2 | Y-A | 80 | 221 | x | Control |
| 3 | Y-3 | 110 | 122 | ○ | Inv. |
| 4 | Y-3 | 80 | 125 | ○ | Inv. |
| 5 | Y-6 | 110 | 121 | ○ | Inv. |
| 6 | Y-6 | 80 | 126 | ○ | Inv. |
| 7 | Y-14 | 110 | 123 | ○ | Inv. |
| 8 | Y-14 | 80 | 125 | ○ | Inv. |
| 9 | Y-21 | 110 | 122 | ○ | Inv. |
| 10 | Y-21 | 80 | 127 | ○ | Inv. |
| 11 | Y-2 | 110 | 125 | ○ | Inv. |
| 12 | Y-2 | 80 | 129 | ○ | Inv. |
| 13 | Y-54 | 110 | 125 | ○ | Inv. |
| 14 | Y-54 | 80 | 129 | ○ | Inv. |
| 15 | Y-25 | 110 | 127 | ○ | Inv. |

As is apparent from Table-1, the constitutions outside of the present invention (No. 1 - 2) are elevated in incorrect absorption density at image portion before and after continuous portion to 2-fold or higher when the amount of the color developer replenished is reduced, but in the constitutions of the present invention (No. 3 - 16), it is improved to 1.3-fold or less, and deterioration of reproducibility is substantially unrecognizable by observation with naked eyes.

EXAMPLE-2

Except for using the silver chlorobromide emulsions shown below as the respective color sensitive emulsions, the same sample as in Example-1 was prepared.

The respective color sensitive emulsions were prepared as described below.

Blue-Sensitive Silver Chlorobromide Emulsion

A silver chlorobromide emulsion with an average grain size of 0.7 μm and a silver bromide content of 90 mole % was sensitized optimally at 57° C. by use of sodium thiosulfate, and a sensitizing dye (D-1) and Z-1 as the stabilizer were added.

Green-Sensitive Silver Chlorobromide Emulsion

A silver chlorobromide emulsion with an average grain size of 0.5 μm and a silver bromide content of 70 mole % was sensitized optimally at 57° C. by use of sodium thiosulfate, and a sensitizing dye (D-2) and Z-1 as the stabilizer were added.

Red-Sensitive Silver Chlorobromide Emulsion

A silver chlorobromide emulsion with an average grain size of 0.4 μm and a silver bromide content of 60 mole % was sensitized optimally at 60° C. by use of sodium thiosulfate, a sensitizing dye (D-3) and a phenol resin, and Z-1 as the stabilizer was added.

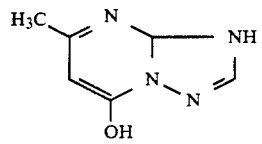

Z-1

By use of this sample, following the processing steps shown below, continuous processing was performed until 3-fold of the tank volume of the color developer was replenished.

Processing steps (processing temperature and processing time):

| | Temperature | Time |
|---|---|---|
| Color developing | 38° C. | 3 min. 30 sec. |
| Bleach-fixing | 33° C. | 1 min. 30 sec. |
| Water washing | 25–30° C. | 3 min. |
| Drying | 75–80° C. | about 2 min. |

The compositions of the respective color developers are shown below.

The amount of the color developer replenished is 61 ml/m$^2$ (light-sensitive material).

| | Tank solution | Replenished solution |
|---|---|---|
| [Color developer] | | |
| Benzyl alcohol | 15 ml | 38 ml |
| Diethylene glycol | 10 g | 23 g |
| Potassium sulfite | 2.0 g | 4.0 g |
| Potassium bromide | 3.5 g | — |
| Sodium chloride | 0.2 g | — |
| Potassium carbonate | 30.0 g | 30.0 g |
| Hydroxylamine sulfate | 3.0 g | 6.0 g |
| Polyphosphoric acid (TPPS) | 2.5 g | 5.0 g |
| N-ethyl-N-(β-methanesulfonamidoethyl-3-methyl-4-aminoaniline sulfate | 5.5 g | 14.0 g |
| Fluorescent brightener (4,4'-diaminostilbene-disulfonic acid derivative) | 1.0 g | 2.5 g |
| pH (adjusted with potassium hydroxide or sulfuric acid) | 10.20 | 10.90 |
| The total amount is made up to one liter with addition of water. | | |
| [Bleach-fixing solution] | | |
| Ferric ammonium ethylenediaminetetraacetate dihydrate | | 60 g |
| Ethylenediaminetetraacetic acid | | 3 g |
| Ammonium thiosulfate (70% aqueous solution) | | 100 ml |
| Ammonium sulfite (40% solution) | | 27.5 ml |

The pH is adjusted to 7.1 with potassium carbonate or glacial acetic acid, and the total amount made up to one liter with addition of water.

The above sample was exposed in conventional manner, continuously processed and the following tests were conducted before and after continuous processing.

(1) Spectral absorption characteristics of yellow color forming dye:

Similarly as in Example-1, the difference in reflection density at 650 nm ($\Delta D_{650}$) before and after continuous processing was determined and evaluated by relative value.

(2) Color reproducibility:

Evaluated similarly as in Example-1.

The results are shown in Table-2.

TABLE 2

| Experiment No. | Constitution: Yellow coupler | Constitution: Amount Replenished ml/m$^2$ | Results: Change rate of $\Delta D_{650}$(%) | Results: Color reproducibility | Remarks |
|---|---|---|---|---|---|
| 17 | Y-B | 61 | 124 | x | Control |
| 18 | Y-3 | 61 | 109 | ○ | Inv. |
| 19 | Y-6 | 61 | 110 | ○ | Inv. |
| 20 | Y-14 | 61 | 109 | ○ | Inv. |
| 21 | Y-21 | 61 | 110 | ○ | Inv. |
| 22 | Y-2 | 61 | 111 | ○ | Inv. |
| 23 | Y-54 | 61 | 112 | ○ | Inv. |
| 24 | Y-25 | 61 | 112 | ○ | Inv. |

(Y-B)

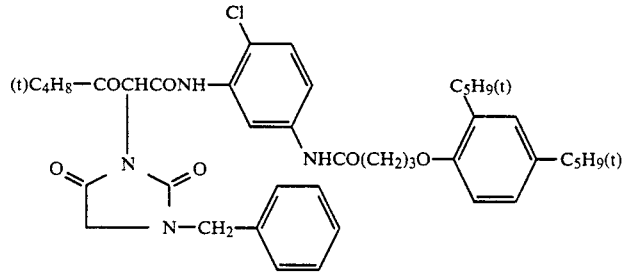

The constitutions of the present invention (No. 18–24) are lower in incorrect absorption density before and after continuous processing as compared with Control (No. 17) to give good color reproducibility.

EXAMPLE-3

Even when the yellow couplers were varied as Y-1, Y-8, Y-9, Y-17, Y-22, Y-28, Y-30, Y-39, Y-45, Y-47 with the same constitutions as in Example-1 and Example-2, the effects of the present invention were obtained.

EXAMPLE-4

Light-sensitive silver halide photographic materials having constitutions similar to the experiments No. 1 and No. 3 in Example-1 were prepared, and processed similarly as in Example-1.

However, the amounts of the color developer replenished were made 180 ml for A, 140 ml for B, 110 ml for C, 80 ml for D and 60 ml for E, per 1 m$^2$ of light-sensitive material.

The above samples were exposed in conventional manner, and processed continuously. The reflection density at 650 nm was determined according to the same method as in Example-1, and the difference in reflection density from Comparative sample ($\Delta D_{650}$) was determined and evaluated by relative value.

The results are shown in Table-3.

TABLE 3

| | Amount Replenished ml/m$^2$ | Relative value at $\Delta D_{650}$ | Color reproducibility |
|---|---|---|---|
| A | 180 | 100 | x |
| B | 140 | 367 | ○ |
| C | 110 | 405 | ○ |
| D | 80 | 457 | ○ |

TABLE 3-continued

| | Amount Replenished ml/m$^2$ | Relative value at $\Delta D_{650}$ | Color reproducibility |
|---|---|---|---|
| E | 60 | 466 | ○ |

As is apparent from the above table, it can be appreciated that B–E with the amount of color developer replenished within the range of the present invention have great effects, and also that the effect is greater as the amount replenished is smaller.

As can be seen clearly from the above description, according to the present invention, there can be provided a light-sensitive silver halide photographic material with excellent stability of photographic performance, and sufficient color reproducibility even when low replenishing continuous running processing may be performed.

We claim:

1. A method for processing a light-sensitive silver halide photographic material having at least one silver halide emulsion layer characterized in that at least one of said silver halide emulsion layers contains a yellow coupler represented by the formula (Y-I) shown below, and the light-sensitive silver halide photographic material is processed with a color developer whose replenished amount is in the range of 20 to 150 ml per 1 m$^2$ of said light-sensitive silver halide photographic material, Formula (Y-I)

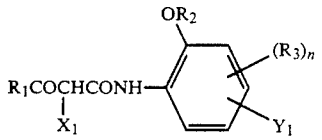

wherein $R_1$ represents an alkyl, cycloalkyl or aryl group; $R_2$ and alkyl, cycloalkyl, aryl or acyl group; $R_3$ a group substitutable on a benzene ring; n is 0 or 1; $X_1$ represents a group eliminable during coupling with the oxidized product of a developing agent represented by Formula (Y-VI)

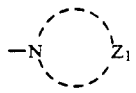

wherein $Z_1$ represents a group of non-metallic atoms which form a 5 or 6 membered ring together with the nitrogen atom; and $Y_1$ represents an organic group.

2. The method according to claim 1, wherein $R_1$ is at least one group selected from the group consisting of a methyl group, an ethyl group, an isopropyl group, a t-butyl group, a dodecyl group, an alkyl group having at least one substituent selected from the group consisting of halogen atoms, aryl groups, alkoxy groups, aryloxy groups, alkylsulfonyl groups, acylamino groups and hydroxyl groups, cyclopropyl groups, cyclohexyl groups, adamantyl groups and phenyl groups.

3. The method according to claim 1, wherein $R_1$ is a branched alkyl group.

4. The method according to claim 1, wherein $R_2$ is an alkyl group or an aryl group.

5. The method according to claim 4, wherein $R_2$ is an alkyl group.

6. The method according to claim 5, wherein $R_2$ is an alkyl group having 5 or less carbon atoms.

7. The method according to claim 1, wherein $R_3$ is selected from the group consisting of a halogen atom, an alkyl group, an alkoxy group, an aryloxy group, an acyloxy group, an acylamino group, a carbamoyl group, an alkylsulfonamide group, an arylsulfonamide group, a sulfamoyl group and an imide group.

8. The method according to claim 1, wherein $Y_1$ is a compound represented by formula Y-II:

$$-J-R_4- \qquad \text{Y-II}$$

wherein $R_4$ represents an organic group containing one bonding group having carbonyl or sulfonyl unit and J represents $$-\underset{\underset{R_5}{|}}{N}CO- \text{ or } -CO\underset{\underset{R_5}{|}}{N}-$$

where $R_5$ represents a hydrogen atom, an alkyl group, an aryl group or a heterocyclic group.

9. The material according to claim 8, wherein the yellow coupler of formula Y-I is a compound represented by the formula Y-V

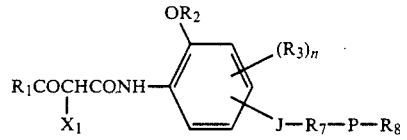

Y-V wherein $R_1$, $R_2$, $R_3$, $X_1$ and J represent the same group $R_1$, $R_2$, $R_3$ and $X_1$ in formula Y-I and J in formula Y-II; n represents 0 or 1; $R_7$ represents an alkylene, arylene, alkylenearylene or arylenealkylene group or —A—$V_1$—B— wherein A and B each represent an alkylene, arylene, alkylenearylene or arylenealkylene group, and $V_1$ represents a divalent linking group; $R_8$ represents an alkyl, cycloalkyl, aryl or heterocyclic group; and P represents a bonding group having a carbonyl or sulfonyl unit.

10. The method according to claim 9, wherein P represents at least one compound selected from the group consisting of compounds represented by the formulas 1 to 9:

$$-COO-, \qquad 1)$$

$$-\underset{\underset{R}{|}}{N}CO-, \qquad 2)$$

$$-CO\underset{\underset{R}{|}}{N}-, \qquad 3)$$

$$-\underset{\underset{R}{|}}{N}CO\underset{\underset{R}{|}}{N}-, \qquad 4)$$

$$-\underset{\underset{R}{|}}{N}COO-, \qquad 5)$$

$$-SO_2-, \qquad 6)$$

$$-\underset{\underset{R}{|}}{N}SO_2-, \qquad 7)$$

-continued

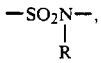

8)

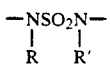

9)

where R and R′ represent a hydrogen atom, an alkyl group, an aryl group or a heterocyclic group, and R and R′ may be either the same or different.

11. The method according to claim 10, wherein R and R′ each represent a hydrogen atom.

12. The method according to claim 1, wherein the amount of the yellow coupler of formula Y-I is in the range from $1\times10^{-3}$ to 1 mole per 1 mole of a silver halide.

13. The method according to claim 12, wherein the amount of the yellow coupler is in the range from $1\times10^{-2}$ to $8\times10^{-1}$ mole per 1 mole of silver halide.

14. The method according to claim 1, wherein the color developing agent to be used in the color developer is at least one of an aminophenol type or p-phenylenediamine type compound.

15. The method according to claim 14, wherein the color developing agent is a p-phenylenediamine type compound having a water soluble group.

16. The method according to claim 15, wherein the water soluble group is at least one selected from the group consisting of

—COOH, $—SO_3H$, $—(CH_2)_n—CH_2OH$, $—(CH_2)_m—NHSO_2—(CH_2)_n—CH3$, $—(CH_2)_m—O—(CH_2)_n—CH_3$ and $—(CH_2CH_2O)_nC_mH_{2m+1}$ where m and n each representing an integer of 0 or more.

17. The method according to claim 1, wherein the color developing agent is selected from the group consisting of A-1 to A-4, A-6, A-7 and A-15:

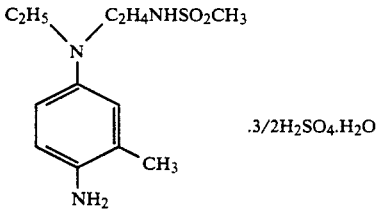

A-1

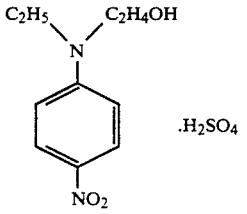

A-2

-continued

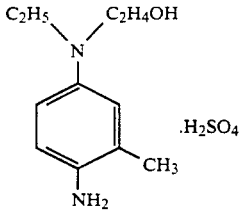

A-3

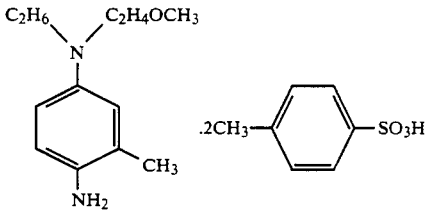

A-4

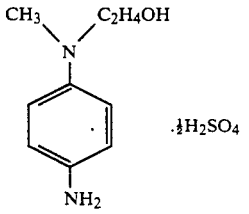

A-6

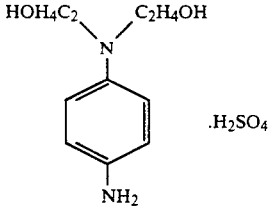

A-7

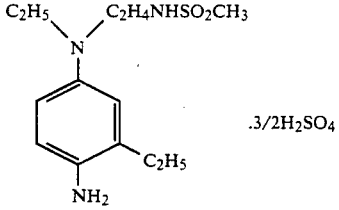

A-15

18. The method according to claim 17, wherein the color developing agent is A-1:

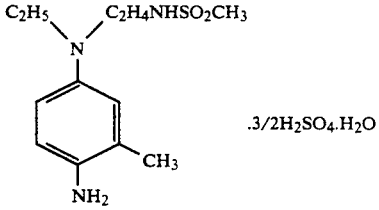

A-1

19. The method according to claim 1, wherein the amount of the color developing agent is in the range from $1.0\times10^{-2}$ to $2.0\times10^{-1}$ mole per 1 liter of the color developer.

20. The method according to claim 19, wherein the amount of the color developing agent is in the range from $1.5\times10^{-2}$ to $2.0\times10^{-1}$ mole per 1 liter of the color developer.

21. The method according to claim 1 wherein the pH value of the color developer is in the range from 9.5 to 13.0.

22. The method according to claim 21, wherein the pH value of the color developer is in the range from 9.8 to 12.

23. The method according to claim 1, wherein the processing temperature of the color developer is in the range from 30° C. to 50° C.

24. The method according to claim 23, wherein the processing temperature of the color developer is in the range from 33° C. to 45° C.

25. The method according to claim 1, wherein the amount of the color developer replenished is in the range from 20 to 120 ml/m$^2$.

26. The method according to claim 25, wherein the amount of the color developer replenished is in the range from 20 to 100 ml/m$^2$.

27. The method according to claim 1, wherein the silver halide to be used in the photographic material is at least one selected from the group consisting of silver bromide, silver iodobromide, silver iodochloride, silver chlorobromide and silver chloride.

28. The method according to claim 27, wherein the silver halide contains 90 mole % or more of silver chloride.

29. The method according to claim 27, wherein the silver halide contains 10 mole % or less of silver bromide.

30. The method according to claim 27, wherein the silver halide contains 0.5 mole % or less of silver iodide.

31. The method according to claim 27, wherein the silver halide is a silver chlorobromide with a silver halide content of 0.1 to 2 mole %.

* * * * *

UNITED STATES PATENT AND TRADEMARK OFFICE

CERTIFICATE OF CORRECTION

PATENT NO. : 5,219,716

DATED : June 15, 1993

INVENTOR(S) : Shun Takada et al.

It is certified that error appears in the above-indentified patent and that said Letters Patent is hereby corrected as shown below:

Column 80, line 24, claim 9, change "material" to --method --.

Signed and Sealed this

Twenty-second Day of March, 1994

Bruce Lehman

*Attest:*

BRUCE LEHMAN

*Attesting Officer*

*Commissioner of Patents and Trademarks*